US012806489B1

(12) United States Patent
Dunehew

(10) Patent No.: US 12,806,489 B1
(45) Date of Patent: Nov. 24, 2026

(54) MULTI-ADJUSTABLE PUTTER

(71) Applicant: ACHANES LLC, Nokomis, FL (US)

(72) Inventor: Shawn Dunehew, Nokomis, FL (US)

(73) Assignee: ACHANES LLC, Nokomis, FL (US)

( * ) Notice: Subject to any disclaimer, the term of this patent is extended or adjusted under 35 U.S.C. 154(b) by 168 days.

(21) Appl. No.: 18/585,549

(22) Filed: Feb. 23, 2024

Related U.S. Application Data

(60) Provisional application No. 63/448,726, filed on Feb. 28, 2023.

(51) Int. Cl.

| | |
|---|---|
| ***A63B 53/06*** | (2015.01) |
| ***A63B 53/00*** | (2015.01) |
| ***A63B 53/02*** | (2015.01) |
| ***A63B 60/00*** | (2015.01) |
| *A63B 53/04* | (2015.01) |

(52) U.S. Cl.
CPC ..... *A63B 53/065* (2013.01); *A63B 53/007* (2013.01); *A63B 53/023* (2020.08); *A63B 60/0085* (2020.08); *A63B 2053/0491* (2013.01)

(58) Field of Classification Search
CPC . A63B 53/0487; A63B 53/028; A63B 53/065; A63B 53/007; A63B 53/023; A63B 53/022; A63B 2053/0491
USPC ..... 473/341
See application file for complete search history.

(56) References Cited

U.S. PATENT DOCUMENTS

| | | | | |
|---|---|---|---|---|
| 1,334,189 | A | 3/1920 | Swanson | |
| 2,325,525 | A | 7/1943 | Lukenbill | |
| 3,214,169 | A | 10/1965 | Rupnow | |
| 3,392,977 | A | 7/1968 | De Lacey | |
| 3,397,888 | A | 8/1968 | Springer | |
| 3,516,674 | A | 6/1970 | Scarborough | |
| 4,121,832 | A | 10/1978 | Ebbing | |
| 5,116,047 | A * | 5/1992 | Phelan | A63B 53/007 473/307 |
| 5,282,619 | A * | 2/1994 | Napolitano | A63B 60/00 473/239 |
| 5,320,346 | A | 6/1994 | Phillips | |
| 5,407,196 | A * | 4/1995 | Busnardo | A63B 53/065 473/307 |
| 5,437,447 | A | 8/1995 | Rigutto | |
| 5,452,891 | A * | 9/1995 | Thomas | A63B 53/14 473/294 |
| 5,628,713 | A | 5/1997 | Wilkinson | |
| 5,649,870 | A * | 7/1997 | Harrison | A63B 53/007 473/239 |
| 5,863,257 | A | 1/1999 | Busnardo | |
| 6,238,303 | B1 | 5/2001 | Fite | |

(Continued)

OTHER PUBLICATIONS

R&A Rules Limited (The R&A) and United States Golf Association (USGA). "The Equipment Rules." (Dec. 1, 2024), version 1.3, obtained from https://www.usga.org/content/dam/usga/pdf/Equipment/Equipment-Rules-2020-v12-edits.pdf on Jun. 11, 2026; totaling 99 pages.

*Primary Examiner* — John E Simms, Jr.
(74) *Attorney, Agent, or Firm* — Steinberger IP Law; Brian S. Steinberger; Hilary F. Steinberger

(57) ABSTRACT

Devices, apparatus, and methods for an improved versatile single putter with a multi-position adjustable loft/lie angle, a telescoping shaft for an adjustable length, adjustable putter face angle, adjustable heal/toe weight adjustment, interchangeable face plate and weights, and an adjustable left and right hand orientation.

7 Claims, 24 Drawing Sheets

(56) References Cited

U.S. PATENT DOCUMENTS 6,270,422 B1 * 8/2001 Fisher ..... A63B 53/0487 473/226
6,283,874 B1 * 9/2001 Studebaker ..... A63B 53/14 473/227
6,379,264 B1 * 4/2002 Forzano ..... A63B 60/02 473/340
6,428,423 B1 8/2002 Merko
6,641,487 B1 11/2003 Hamburger
6,669,573 B2 12/2003 Wood
6,779,277 B2 8/2004 Sones
6,780,120 B2 8/2004 Murray
6,863,620 B2 3/2005 Tucker, Sr.
7,074,135 B2 7/2006 Moore
7,997,997 B2 8/2011 Bennett
8,419,564 B1 4/2013 Solheim
8,449,404 B2 * 5/2013 Thomas ..... A63B 53/02 473/246
8,496,539 B2 7/2013 Solheim
8,523,701 B2 9/2013 Knutson
8,636,607 B2 1/2014 Renna
8,715,103 B1 5/2014 Aguinaldo
8,876,622 B2 11/2014 Beach
8,900,066 B2 12/2014 Solheim
9,061,187 B2 6/2015 Yount
9,433,847 B2 9/2016 Roberts
10,207,159 B2 2/2019 Onuki
10,328,318 B2 6/2019 Onuki
10,350,469 B2 7/2019 Serrano
10,649,161 B2 5/2020 Li
10,806,975 B2 10/2020 Onuki
2002/0032075 A1 * 3/2002 Vatsvog ..... A63B 53/0487 473/334
2004/0087385 A1 * 5/2004 Murray ..... A63B 53/10 473/316
2004/0198529 A1 * 10/2004 Moore ..... A63B 60/20 473/296
2010/0197422 A1 * 8/2010 Thomas ..... A63B 60/00 473/307
2010/0197423 A1 8/2010 Thomas
2011/0294597 A1 12/2011 Teramoto
2012/0077609 A1 3/2012 Tonkin
2013/0217512 A1 8/2013 Arnette
2013/0244805 A1 * 9/2013 Bolane ..... A63B 53/02 473/307
2013/0324286 A1 12/2013 Sander
2014/0094323 A1 * 4/2014 Roberts ..... A63B 53/14 473/227
2014/0194218 A1 * 7/2014 Yount ..... A63B 53/065 473/307
2015/0258390 A1 * 9/2015 DeFrancesco, Jr. ... A63B 53/02 473/313
2016/0184661 A1 * 6/2016 Barrett ..... A63B 53/007 473/409
2017/0259127 A1 * 9/2017 Milleman ..... A63B 53/00
2018/0345088 A1 * 12/2018 Onuki ..... A63B 53/06
2019/0366174 A1 * 12/2019 Milleman ..... A63B 60/04
2020/0197767 A1 * 6/2020 Morelock ..... A63B 53/007
2023/0086761 A1 * 3/2023 Dixon ..... A63B 53/08 473/306
2023/0264081 A1 * 8/2023 Woodward ..... A63B 53/02 473/340
2025/0083002 A1 * 3/2025 Cawthron ..... A63B 53/0487

* cited by examiner

MULTI-ADJUSTABLE PUTTER

CROSS REFERENCE TO RELATED APPLICATIONS

This application claims the benefit of priority to U.S. Provisional Application Ser. No. 63/448,726 filed Feb. 28, 2023, the entire disclosure of this application is incorporated herein by specific reference thereto.

FIELD OF INVENTION

This invention relates to golf putters, and in particular to devices, apparatus, and methods for providing an improved versatile multi-adjustable putter with adjustable telescoping shafts, interchangeable face plate and weights, an adjustable left and right hand orientation, an adjustable loft/lie angle and an adjustable face angle.

BACKGROUND AND PRIOR ART

Golf putters have been proposed over the years to try to solve various problems.

See example, U.S. Pat. No. 1,334,189 to Swanson; U.S. Pat. No. 2,325,525 to Lukenbill; U.S. Pat. No. 3,214,169 to Rupnow; U.S. Pat. No. 3,392,977 to De Lacey; U.S. Pat. No. 3,397,488 to Springer et al.; U.S. Pat. No. 3,516,674 to Scarborough; U.S. Pat. No. 4,121,832 to Ebbing; U.S. Pat. No. 5,116,047 to Phelane et al.; U.S. Pat. No. 5,320,346 to Phillips; U.S. Pat. No. 5,407,196 to Busnardo; U.S. Pat. No. 5,437,447 to Rigutto; U.S. Pat. No. 5,628,713 to Wilkinson; U.S. Pat. No. 5,863,257 to Busnardo; U.S. Pat. No. 6,238,303 to Fite; U.S. Pat. No. 6,428,423 to Merko; U.S. Pat. No. 6,641,487 to Hamburger; U.S. Pat. No. 6,669,573 to Wood et al.; U.S. Pat. No. 6,863,620 to Tucker, Sr.; U.S. Pat. No. 6,779,277 to Sones; U.S. Pat. No. 6,780,120 to Murray; U.S. Pat. No. 7,074,135 to Moore; U.S. Pat. No. 8,419,564 to Solheim et al; U.S. Pat. No. 7,997,997 to Bennett et al.; U.S. Pat. No. 8,449,404 to Thomas et al.; U.S. Pat. No. 8,496,539 to Solheim et al.; U.S. Pat. No. 8,523,701 to Knutson et al.; U.S. Pat. No. 8,636,607 to Renna; U.S. Pat. No. 8,715,103 to Aguinaldo et al.; U.S. Pat. No. 8,876,622 to Beach et al.; U.S. Pat. No. 8,900,066 to Solheim et al. U.S. Pat. No. 9,061,187 to Yount; U.S. Pat. No. 9,433,847 to Roberts; U.S. Pat. No. 10,207,159 to Onuki et al.; U.S. Pat. No. 10,328,318 to Onuki et al.; U.S. Pat. No. 10,350,469 to Serrano et al.; U.S. Pat. No. 10,649,161 to Li et al.; U.S. Pat. No. 10,806,975 to Onnuki et al.; and U.S. Published Patent Applications: 2002/0032075 to Vatsvog; 2010/0197423 to Thomas et al.; 2011/029597 to Termaoto; 2012/0077609 to Tonkin; 2013/0217512 to Arnette; 2013/0324286 to Sander et al.; and 2015/0258390 to DeFrancesco, Jr., which are all incorporated by reference.

The prior art shows various versions of golf clubs having adjustable telescoping shafts, clubs with interchangeable face plate and weights, clubs having adjustable left hand and right hand orientation, and clubs with an adjustable loft angle.

Adjustable Telescoping Shafts

U.S. Pat. No. 3,214,169 to Rupnow shows an adjustable telescoping shaft, with shows a main shaft 11 telescopically connected with a grip shaft portion 12 and secured with a clamp 13 below the grip. The length of the club may be adjusted (column 3, lines 3-10) as well as the angle of inclination of the shaft 11 relative to the club head 15 (column 4, lines 13-33).

U.S. Patents: U.S. Pat. No. 7,074,135 to Moore; and U.S. Pat. No. 8,496,539 to Solheim et al.; also show similar concepts to the Rupnow patent.

Interchangeable Face Plate and Weights.

U.S. Patents: U.S. Pat. No. 6,238,303 to Fite; U.S. Pat. No. 6,428,423 to Merko; U.S. Pat. No. 6,641,487 to Hamburger; and U.S. Published Patent Application 2011/029597 to Termaoto can use interchangeable face plates and weights.

U.S. Pat. No. 6,238,303 to Fite shows a putter with interchangeable ball striking inserts 25 that may made of titanium, graphite, copper, brass, aluminum, steel or PTFE. U.S. Pat. No. 6,428,423 to Merko is relevant in that it shows an interchangeable ball striking insert 4 that may be formed of aluminum, steel, plastic and carbon fiber, and also interchangeable weights. U.S. Pat. No. 6,641,487 to Hamburger also shows the same concepts with an interchangeable faceplate 18 and removably insertable weights 52 that can be adjusted to allow the heel or toe more weighted (see column 3, lines 5-45). U.S. Published Patent Application 2011/029597 to Termaoto also shows an interchangeable faceplate 10 and removably insertable weights 11.

Adjustable Left/Right Hand Orientation

U.S. Pat. No. 9,061,187 to Yount shows an adjustable putter with a left hand and right hand orientation and a plug 130 that may be inserted to the unused position and a bolt 136 directed through a hole 164 in the bottom of the putter body that attaches to a receiver 154 that connects to the shaft to the putter body.

Adjustable Loft Angle

U.S. Pat. No. 6,669,573 to Wood et al.; shows a hosel construction that cooperates with the shaft 12 and the club 14 to angularly position the shaft relative to the club head to obtain a desired lie or loft angle, and may be employed on a putter (column 5, lines, 14-20). U.S. Pat. No. 8,449,404 to Thomas shows a similar concept but with a hexagonal hosel construction where the hosel or head adapter includes a bore having the shape of a regular polygon along an offset axis with respect to the exterior surface of the head adapter so that the head adapter is shaped to receive the shaft adapter in a plurality of different orientations to adjust loft or lie angle.

However, none of the prior art, allows for a single versatile putter with a multi-position loft/lie angle, an adjustable telescoping shaft, adjustable putter face angle, adjustable heal/toe weight adjustment, interchangeable face plate and weights, and an adjustable left and right hand orientation.

Thus, the need exists for solutions to the above problems with the prior art.

SUMMARY OF THE INVENTION

A primary objective of the present invention is to provide devices, apparatus, and methods for providing a single multi versatile golf putter with a multi-position adjustable loft/lie angle, a telescoping shaft for an adjustable length, adjustable putter face angle, adjustable heal/toe weight adjustment, interchangeable face plate and weights, and an adjustable left and right hand orientation.

A secondary objective of the present invention is to provide devices, apparatus, and methods for providing a single multi versatile putter with a multi-position adjustable loft/lie angle, a telescoping shaft for an adjustable length, and adjustable putter face angle.

A third objective of the present invention is to provide devices, apparatus, and methods for providing a single multi versatile adjustable putter with a multi-position adjustable loft/lie angle, and an adjustable left and right hand orientation.

An embodiment of the multi-adjustable golf putter can include a multi-position adjustable loft/lie angle, a telescoping shaft having an adjustable length, an adjustable putter face angle, an adjustable heal/toe weight adjustment, an interchangeable face plate and weights, and an adjustable left and right hand orientation.

The multi-position adjustable loft/lie angle can include an adjustment shaft sleeve attached to a base of a shaft of the putter, and a hand orientation socket in a top portion of a putter head of the putter, wherein the adjustment shaft sleeve is insertable into the hand orientation socket in a plurality of positions which adjust the loft/lie angle of the putter head, the hand orientation socket including a right hand orientation socket for allowing the putter to be used as a right hand putter and a left hand orientation socket for allowing the putter to be used as a left hand putter.

Each of the plurality of positions can include loft angle in degrees, relative to ground in degrees and lie in degrees. The plurality of positions includes up to eight positions.

The interchangeable face plate can include different face plates each with different weights.

The adjustable heal/toe weight adjustment can include interchangeable weights in heal and toe portions of the putter, wherein the interchangeable weights include different materials, each having a different weight.

The adjustable face angle can include a clamp member for the telescoping shaft, which allows an upper golf shaft to retract and expand relative to a lower golf shaft, wherein rotating the upper golf shaft clockwise to a stationary lower golf shaft adjusts the face angle for a right handed configuration golf putter, and rotating the upper golf shaft counterclockwise to a stationary lower golf shaft adjusts the face angle for a left handed configuration golf putter.

The adjustable left and right hand orientation can include a handle attached to a shaft having an adjustment shaft sleeve, and a putter head having a right hand orientation receptacle, and a left hand orientation receptacle, wherein inserting the adjustment shaft sleeve into right hand orientation receptacle allows the putter to be used as a right hand putter, and inserting the adjustment sleeve into the left hand orientation receptacle allows the putter to be used as a left hand putter.

Another embodiment of the multi-adjustable golf putter, can include a multi-position adjustable loft/lie angle, a telescoping shaft with an adjustable length, and an adjustable putter face angle.

The multi-position adjustable loft/lie angle can include an adjustment shaft sleeve attached to a base of a shaft of the putter, and a hand orientation socket in a top portion of a putter head of the putter, wherein the adjustment shaft sleeve is insertable into the hand orientation socket in a plurality of positions which adjust the loft/lie angle of the putter head, the hand orientation socket including a right hand orientation socket for allowing the putter to be used as a right hand putter and a left hand orientation socket for allowing the putter to be used as a left hand putter.

Each of the plurality of positions can include loft angle in degrees, relative to ground in degrees and lie in degrees. The plurality of positions can include up to eight positions.

The adjustable face angle can include a clamp member for the telescoping shaft, which allows an upper golf shaft to retract and expand relative to a lower golf shaft, wherein rotating the upper golf shaft clockwise to a stationary lower golf shaft adjusts the face angle for a right handed configuration golf putter, and rotating the upper golf shaft counterclockwise to a stationary lower golf shaft adjusts the face angle for a left handed configuration golf putter.

Another embodiment of the multi-adjustable golf putter, can include a multi-position adjustable loft/lie angle, an adjustable putter face angle, and an adjustable left and right hand orientation.

The multi-position adjustable loft/lie angle can include an adjustment shaft sleeve attached to a base of a shaft of the putter, and a hand orientation socket in a top portion of a putter head of the putter, wherein the adjustment shaft sleeve is insertable into the hand orientation socket in a plurality of positions which adjust the loft/lie angle of the putter head, the hand orientation socket including a right hand orientation socket for allowing the putter to be used as a right hand putter and a left hand orientation socket for allowing the putter to be used as a left hand putter.

Each of the plurality of positions can include loft angle in degrees, relative to ground in degrees and lie in degrees. The plurality of positions can include up to eight positions.

The adjustable face angle can include a clamp member for connecting an upper golf shaft to a lower golf shaft, wherein rotating the upper golf shaft clockwise to a stationary lower golf shaft adjusts the face angle for a right handed configuration golf putter, and rotating the upper golf shaft counterclockwise to a stationary lower golf shaft adjusts the face angle for a left handed configuration golf putter.

The adjustable left and right hand orientation can include a handle attached to a shaft having an adjustment shaft sleeve, and a putter head having a right hand orientation receptacle, and a left hand orientation receptacle, wherein inserting the adjustment shaft sleeve into right hand orientation receptacle allows the putter to be used as a right hand putter, and inserting the adjustment sleeve into the left hand orientation receptacle allows the putter to be used as a left hand putter.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

Adjustable Mult-Position Loft/Lie Angle 100

Figure 9A:
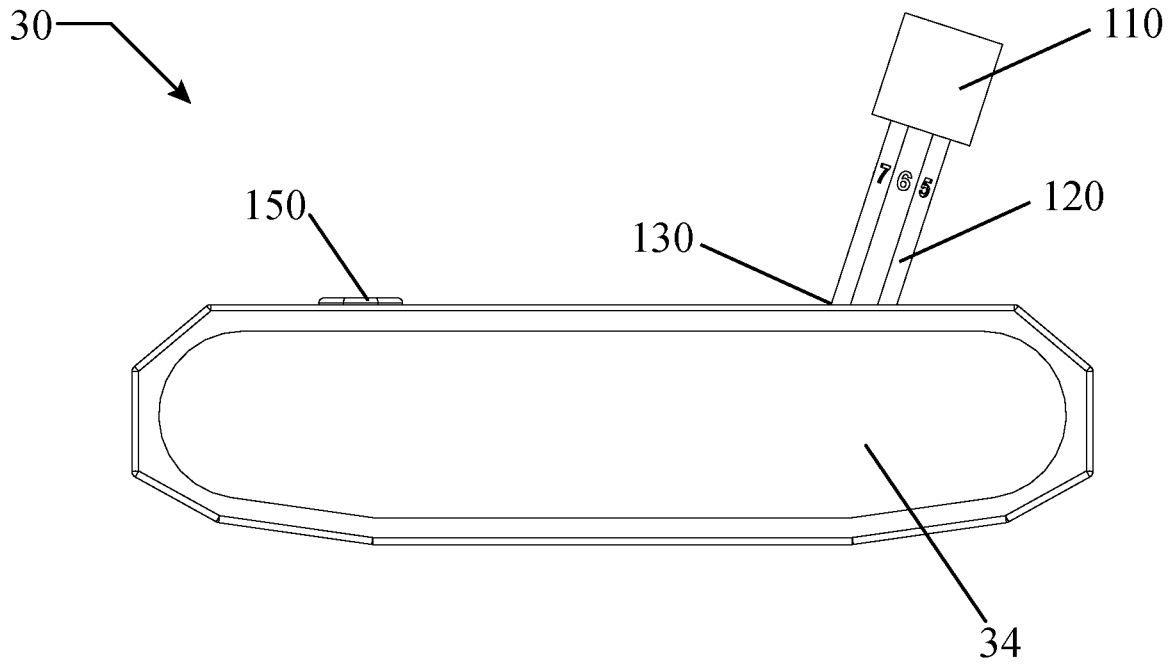

FIG. 9A is a front view of the putter head face side with multi-position adjustable loft/lie angle shaft sleeve in a right putter orientation slot and plug in left putter orientation slot.

Figure 9B:
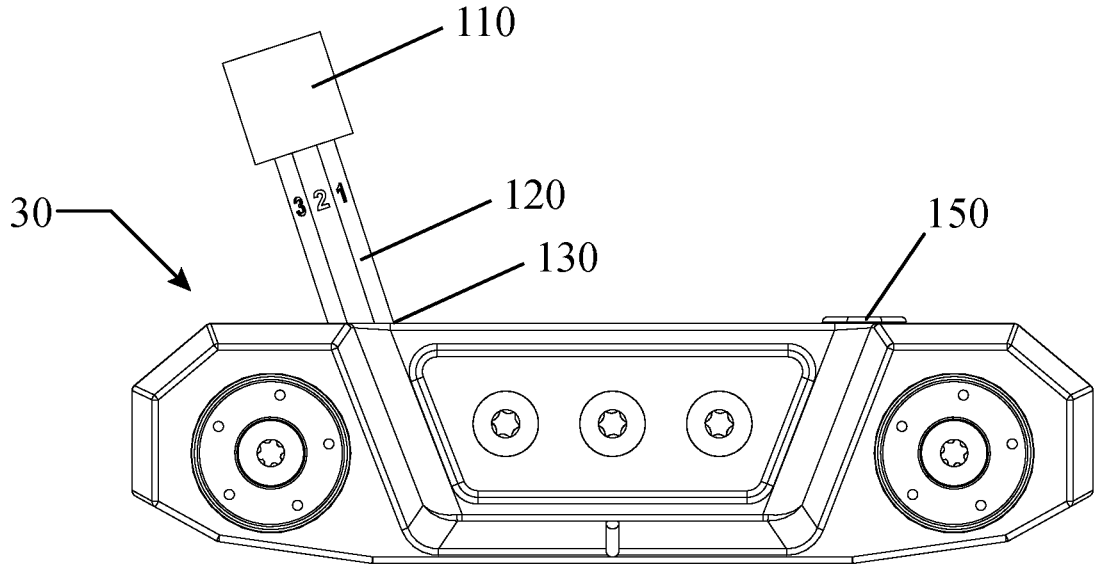

FIG. 9B is a rear view of FIG. 9A.

Figure 10A:
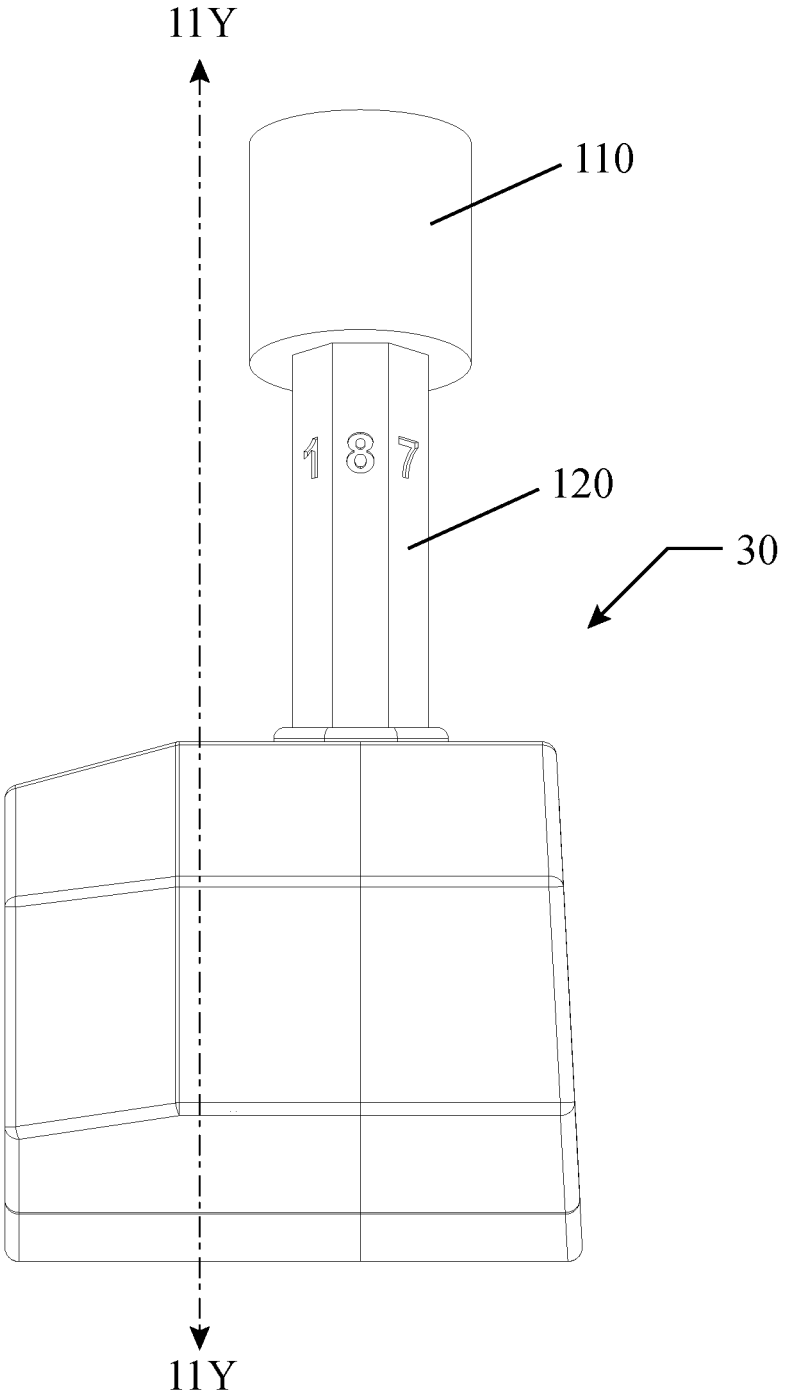

FIG. 10A is an enlarged toe view in right hand configuration of FIG. 9A.

Figure 10B:
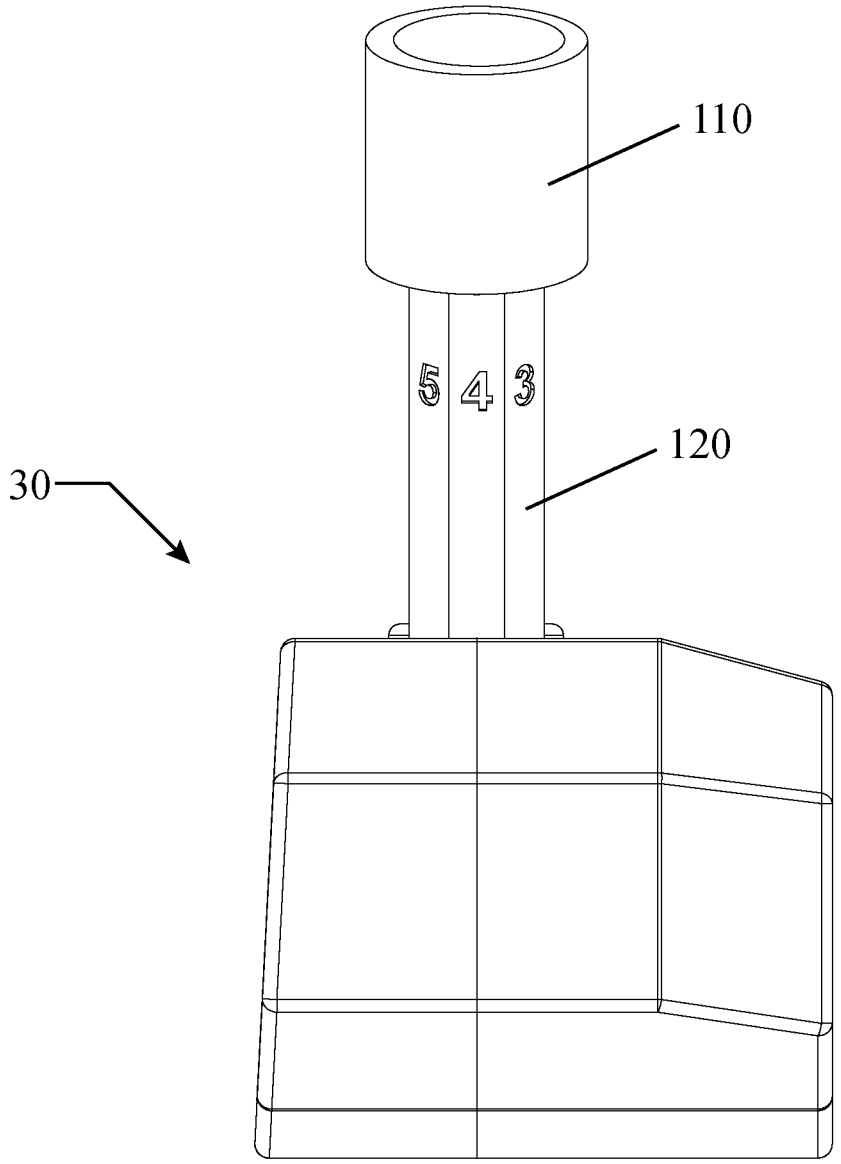

FIG. 10B is an enlarged heal view in right hand configuration of FIG. 9A.

Figure 11A:
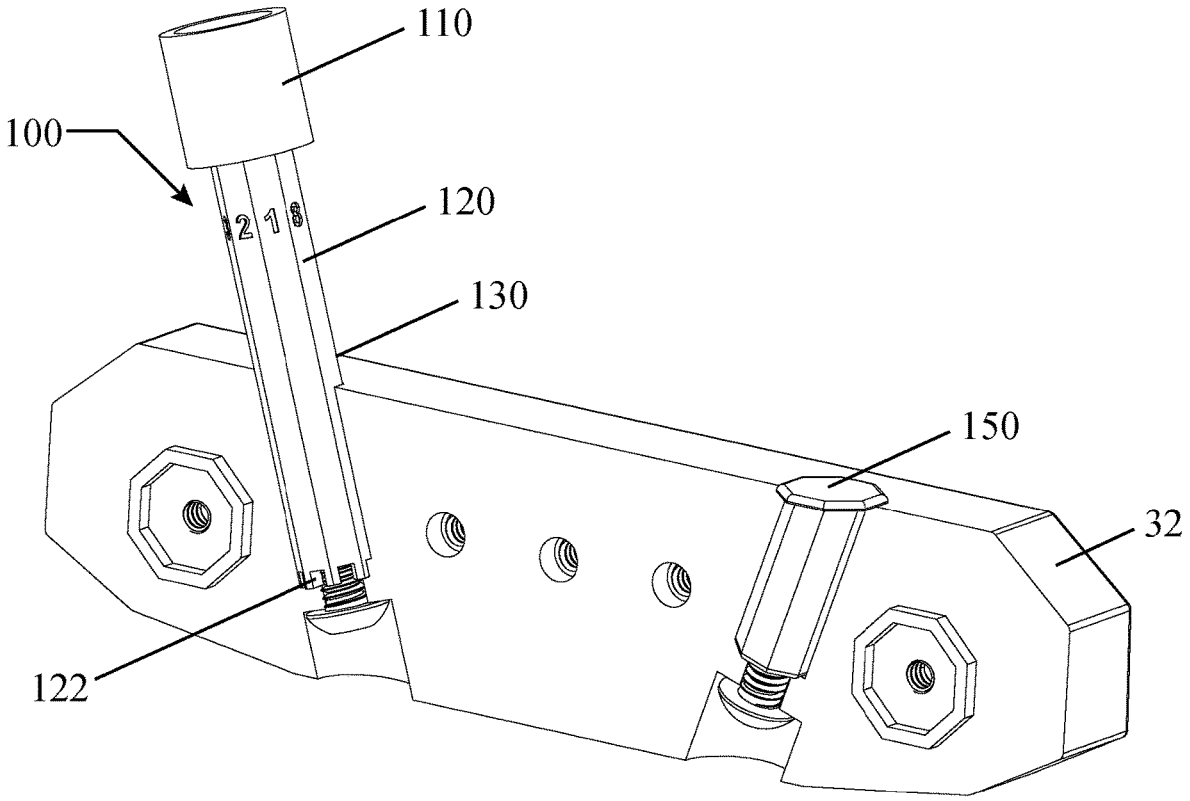

FIG. 11A is a cross-sectional view of the putter head of FIG. 10A along arrow 11Y.

Figure 11B:
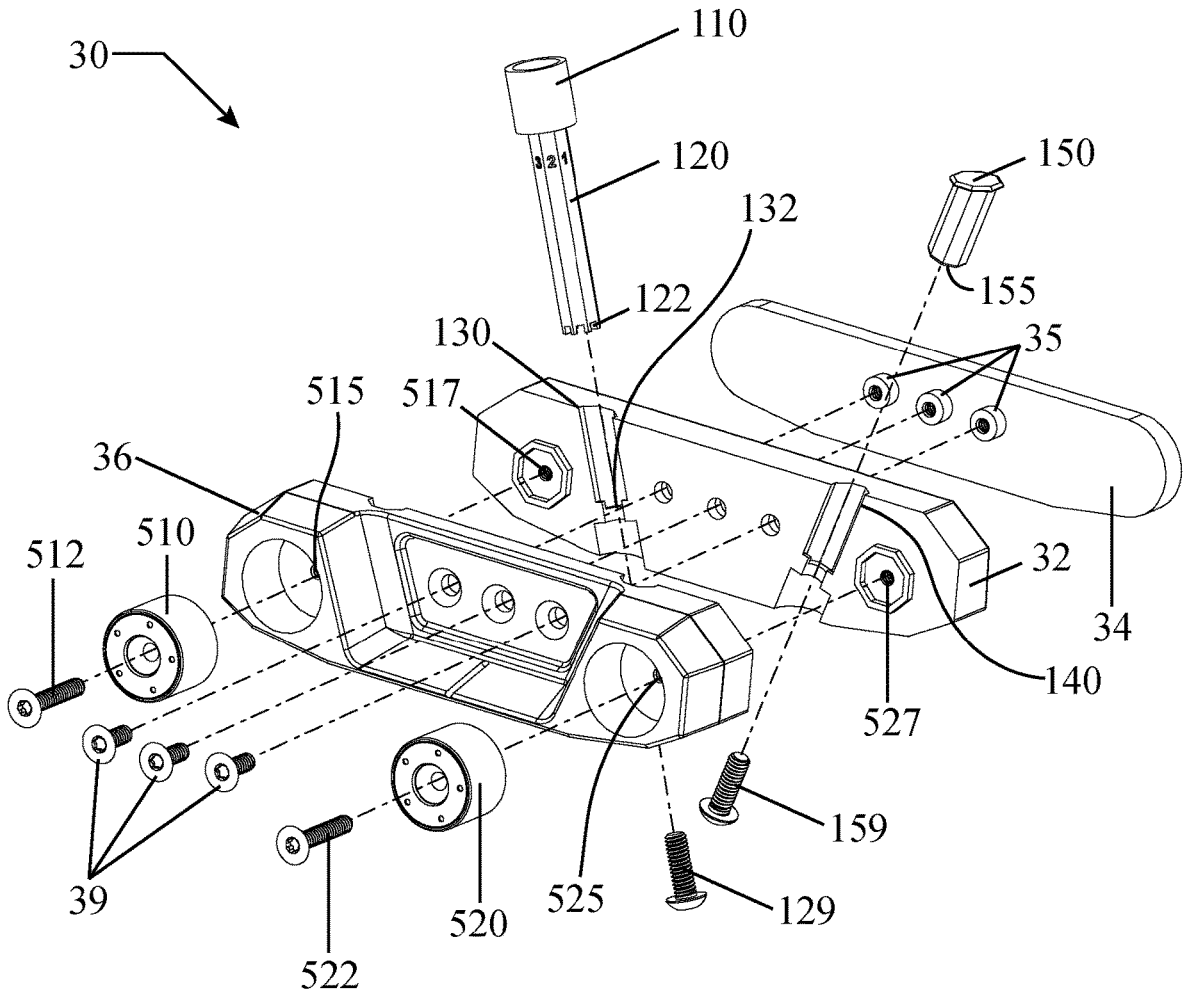

FIG. 11B is an upper exploded rear perspective view of the putter head of FIGS. 9A-11A.

Figure 11C:
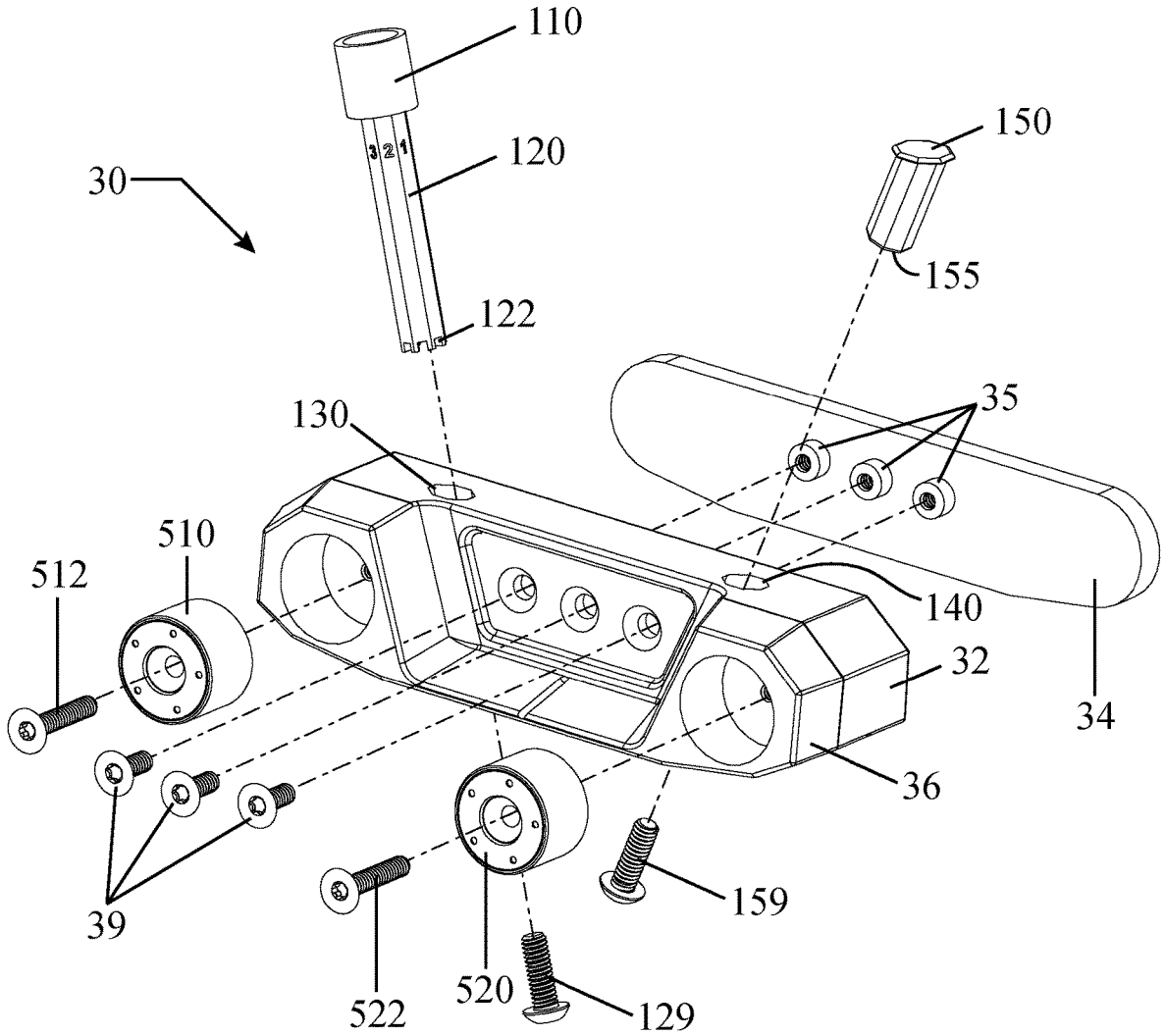

FIG. 11C is another exploded perspective view of the putter head of FIG. 11B with front base attached to rear base of the putter head.

Figure 11D:
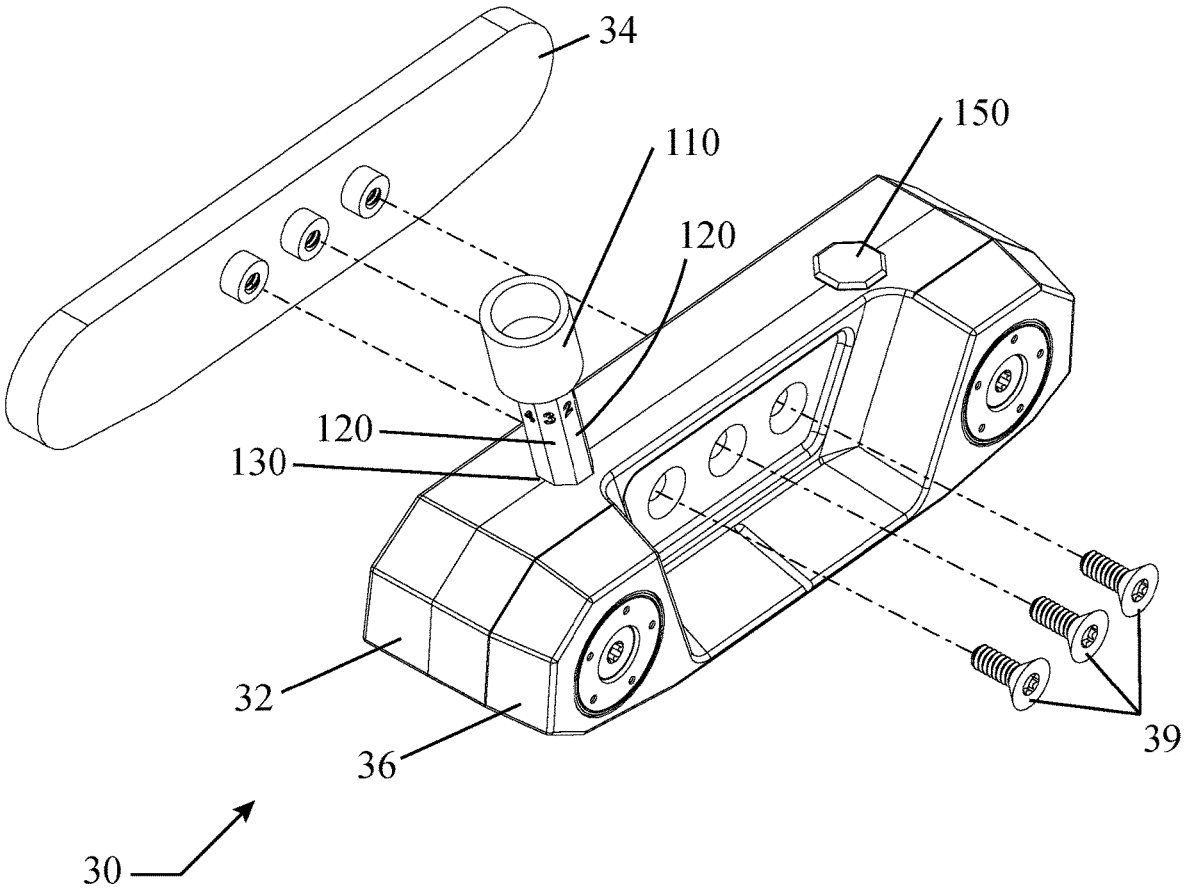

FIG. 11D is another perspective view of the assembled putter head with adjustment shaft sleeve inserted in the right cavity an installed plug in left orientation cavity, and separate face plate.

Figure 11E:
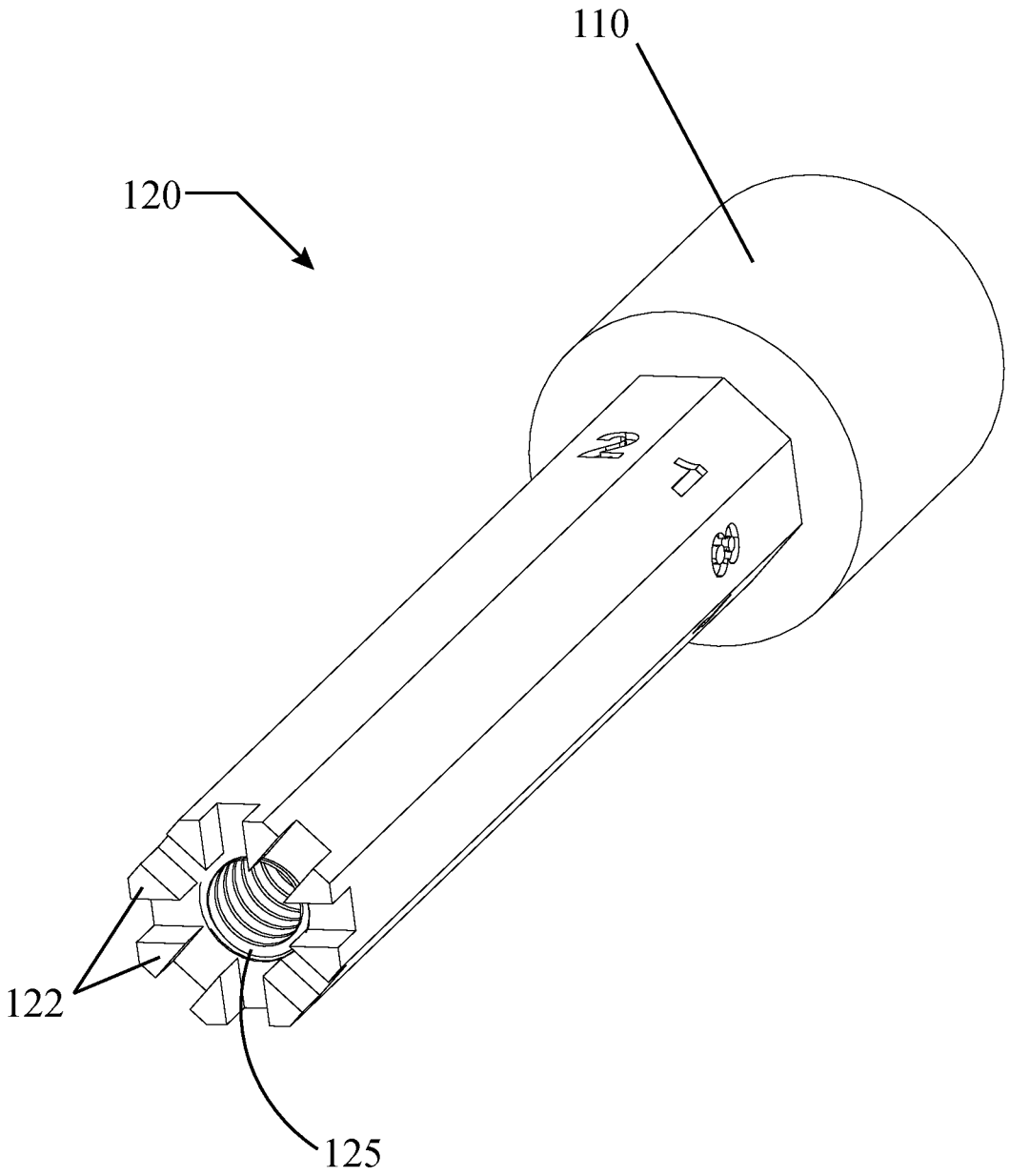

FIG. 11E is a perspective view of the adjustment shaft sleeve used in FIGS. 11A-11D.

Figure 11F:
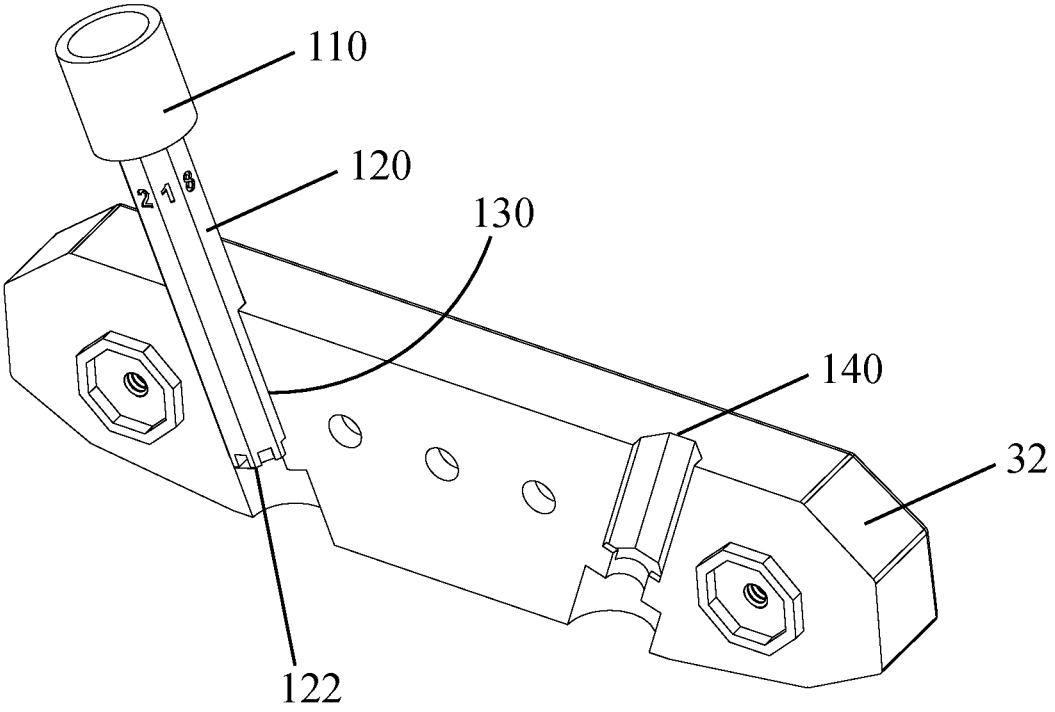

FIG. 11F is a perspective view of the inside surface of the front base of the putter head of FIG. 11D showing the adjustment shaft sleeve, without the plug.

Figure 11G:
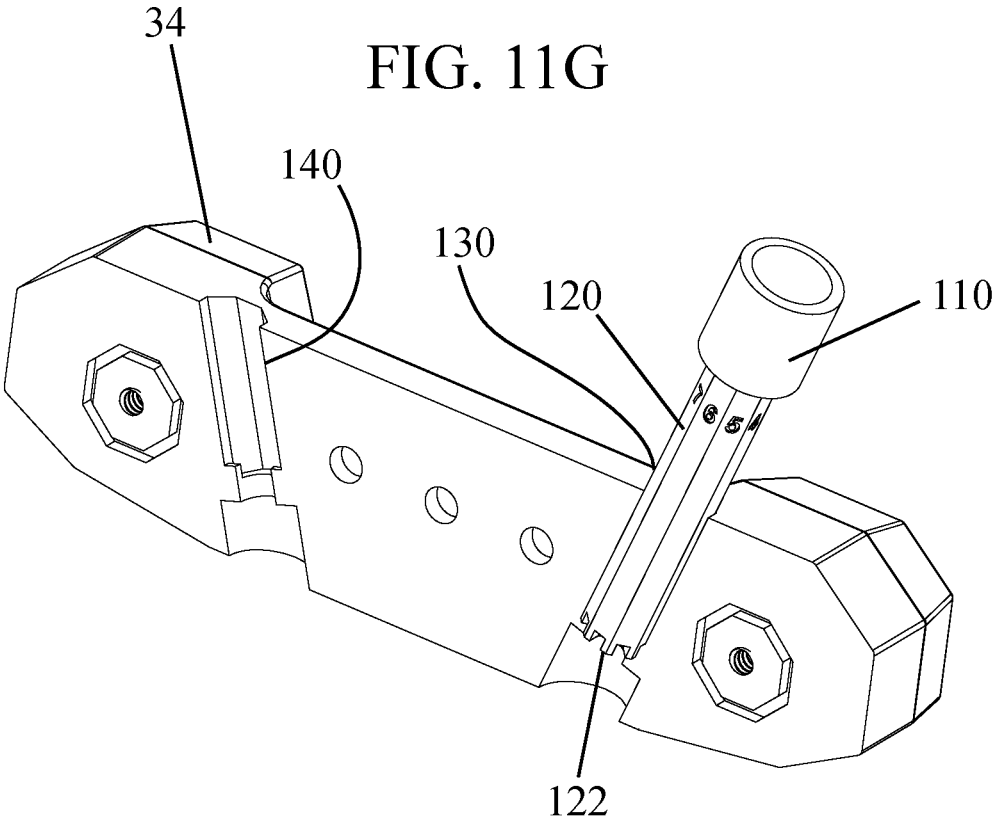

FIG. 11G is a perspective view of the inside surface of the rear base of the putter head of FIG. 11D showing the adjustment shaft sleeve, without the plug.

Figure 11H:
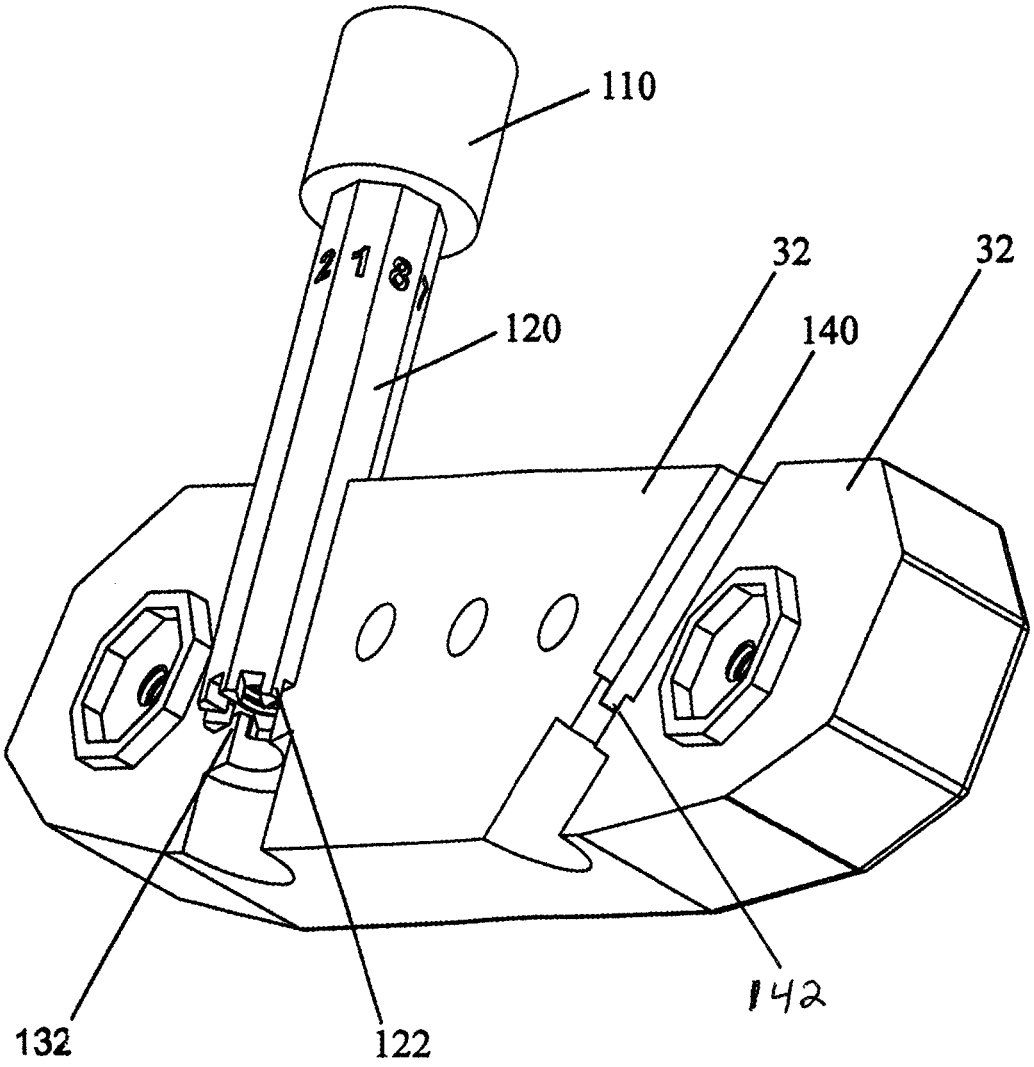

FIG. 11H is an enlarged perspective view of FIG. 11F.

Figure 12A:
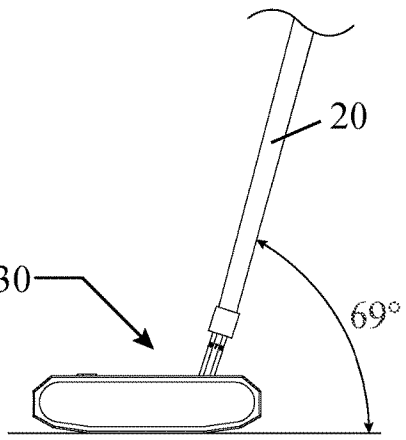
Figure 12A:
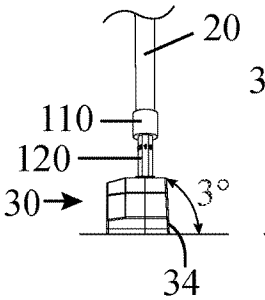

FIG. 12A is a front view of the putter head with shaft in a first loft/lie position.

FIG. 12AR is a right end view of FIG. 12A.

Figure 12B:
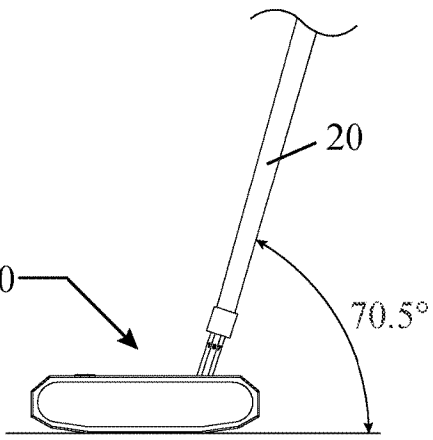
Figure 12B:
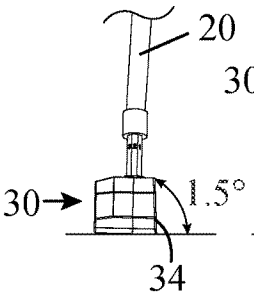

FIG. 12B is a front view of the putter head with shaft in a second loft/lie position.

FIG. 12BR is a right end view of FIG. 12B.

Figure 12C:
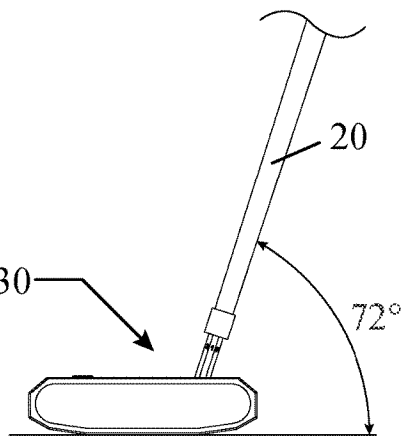
Figure 12C:
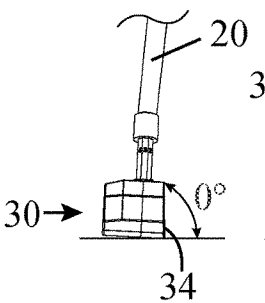

FIG. 12C is a front view of the putter head with shaft in a third loft/lie position.

FIG. 12CR is a right end view of FIG. 12C.

Figure 12D:
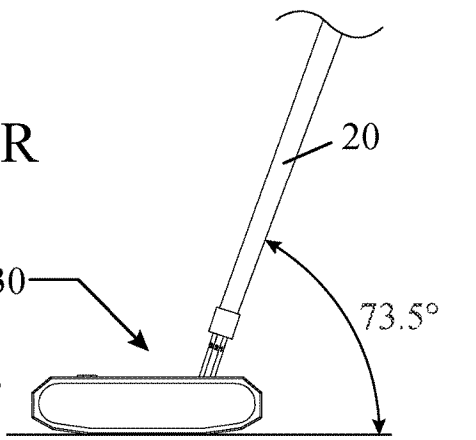
Figure 12D:
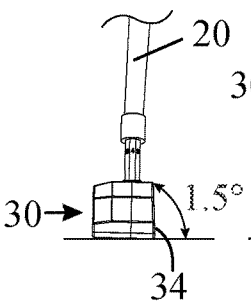

FIG. 12D is a front view of the putter head with shaft in a fourth loft/lie position.

FIG. 12DR is a right end view of FIG. 12D.

Figure 12F:
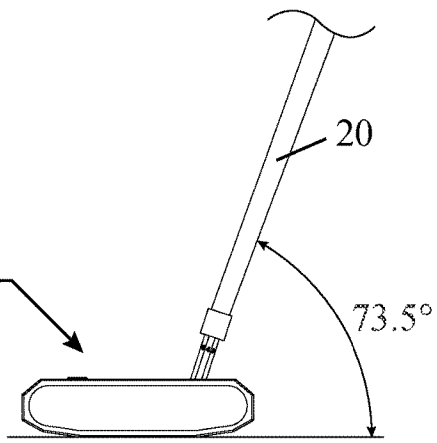
Figure 12F:
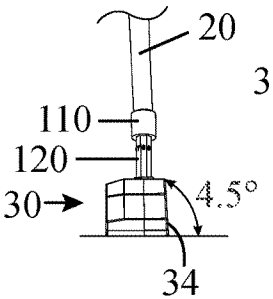
Figure 12E:
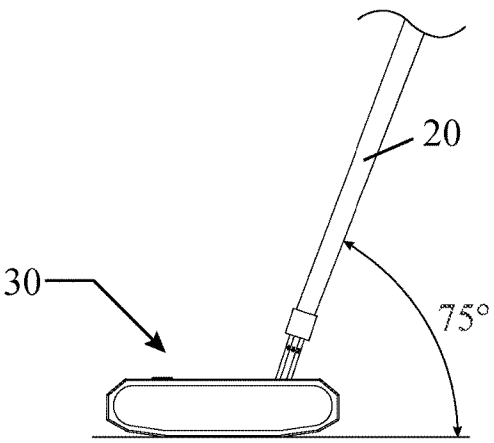
Figure 12E:
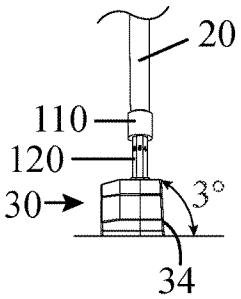

FIG. 12E is a front view of the putter head with shaft in a fifth loft/lie position.

FIG. 12ER is a right end view of FIG. 12E.

FIG. 12F is a front view of the putter head with shaft in a sixth loft/lie position.

FIG. 12FR is a right end view of FIG. 12F.

Figure 12H:
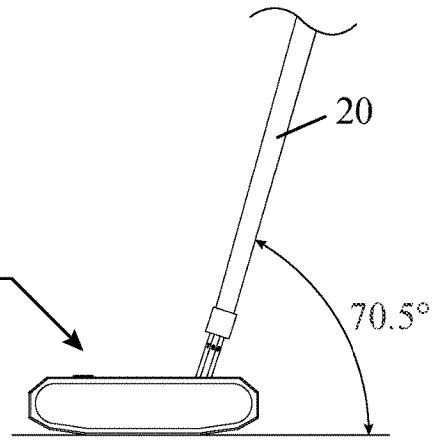
Figure 12H:
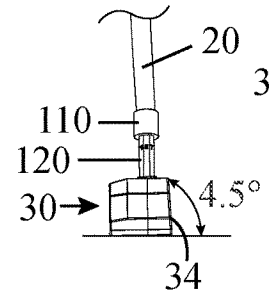
Figure 12G:
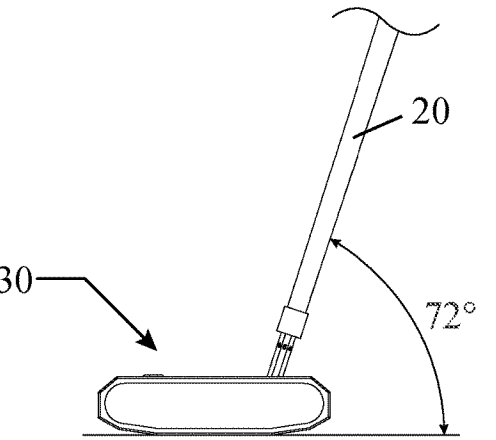
Figure 12G:
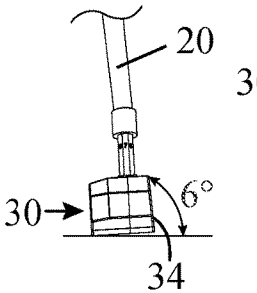

FIG. 12G is a front view of the putter head with shaft in a seventh loft/lie position.

FIG. 12GR is a right end view of FIG. 12G.

FIG. 12H is a front view of the putter head with shaft in an eight loft/lie position.

FIG. 12HR is a right end view of FIG. 12H.

Figure 13C:
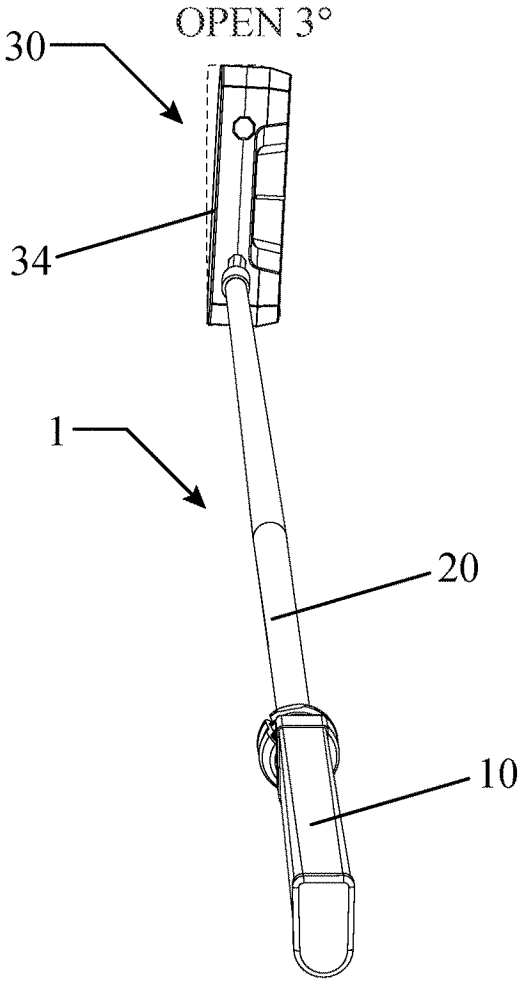
Figure 13B:
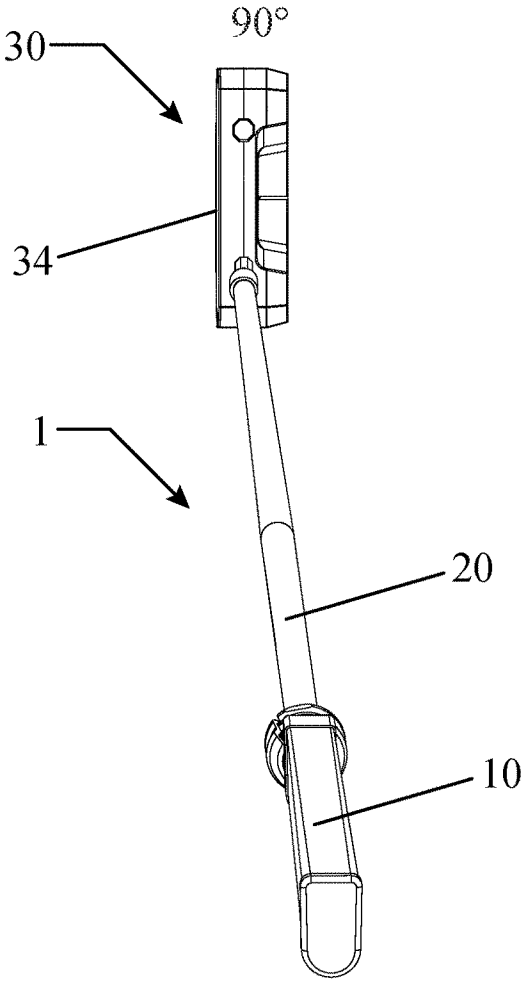
Figure 13A:
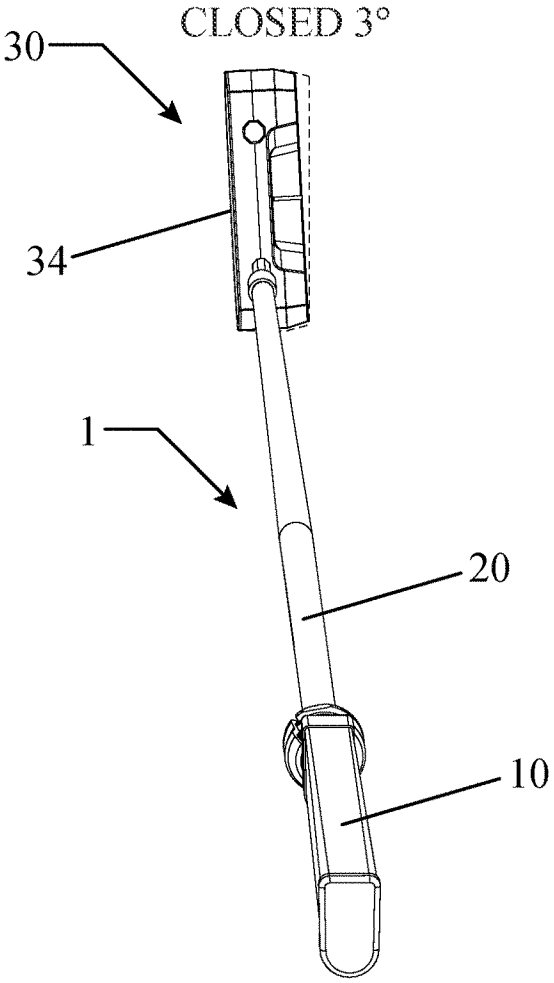

FIG. 13A is a top perspective view of the assembled multi-adjustable putter for a right handed golfer with face plate angle relative to the golfer rotated counter-clockwise at 3 degrees.

FIG. 13B is a top perspective view of the assembled multi-adjustable putter for a right handed golfer with face plate angle perpendicular to ground.

FIG. 13C is a top perspective view of the assembled multi-adjustable putter for a right handed golfer with face plate angle relative to the golfer rotated clockwise at 3 degrees.

Figure 14:
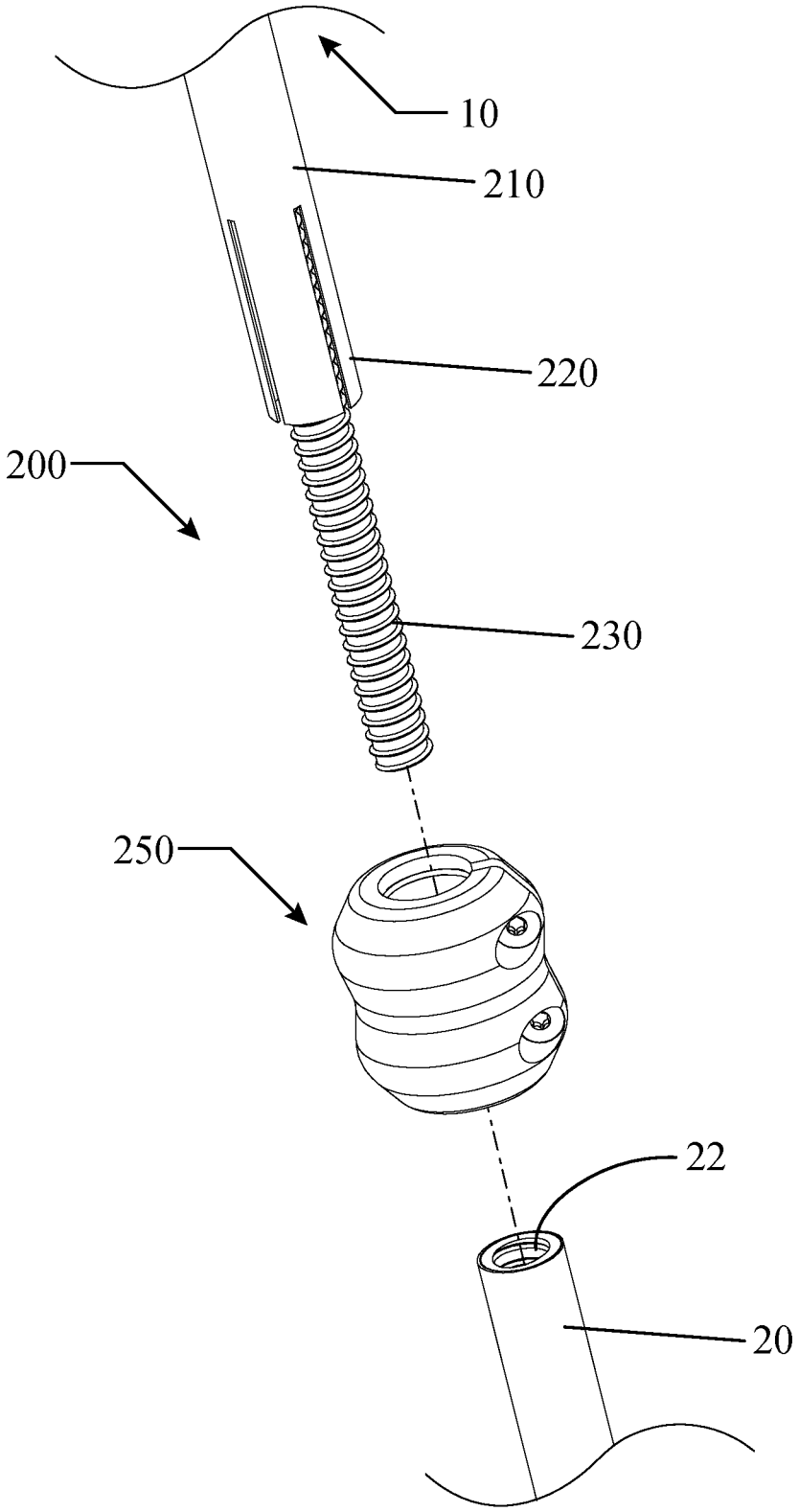

FIG. 14 shows an exploded perspective view of the handle, shaft and length adjustable member.

Figure 15:
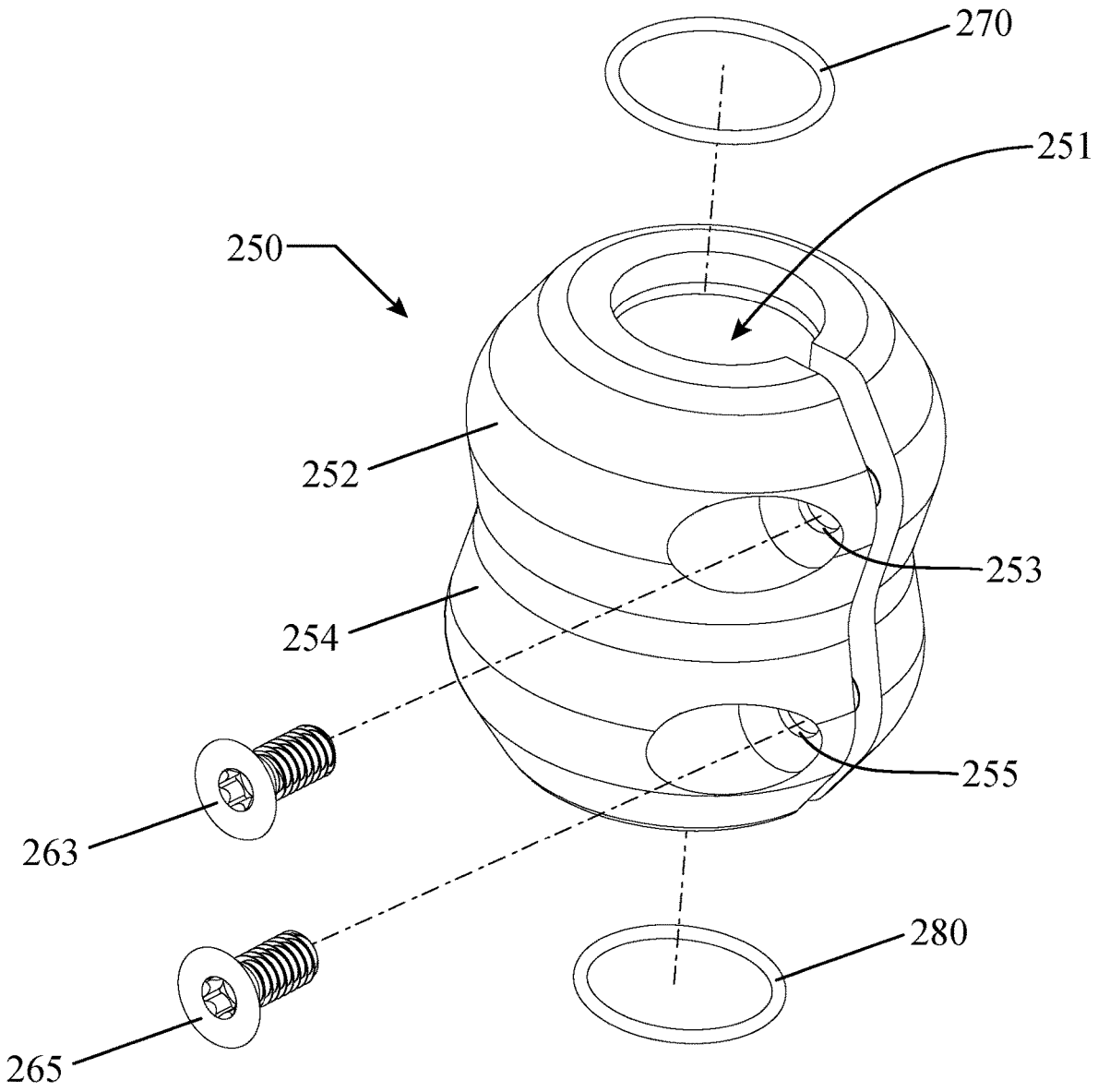

FIG. 15 shows an exploded perspective view of the length adjustable member of FIG. 14.

Figure 16:
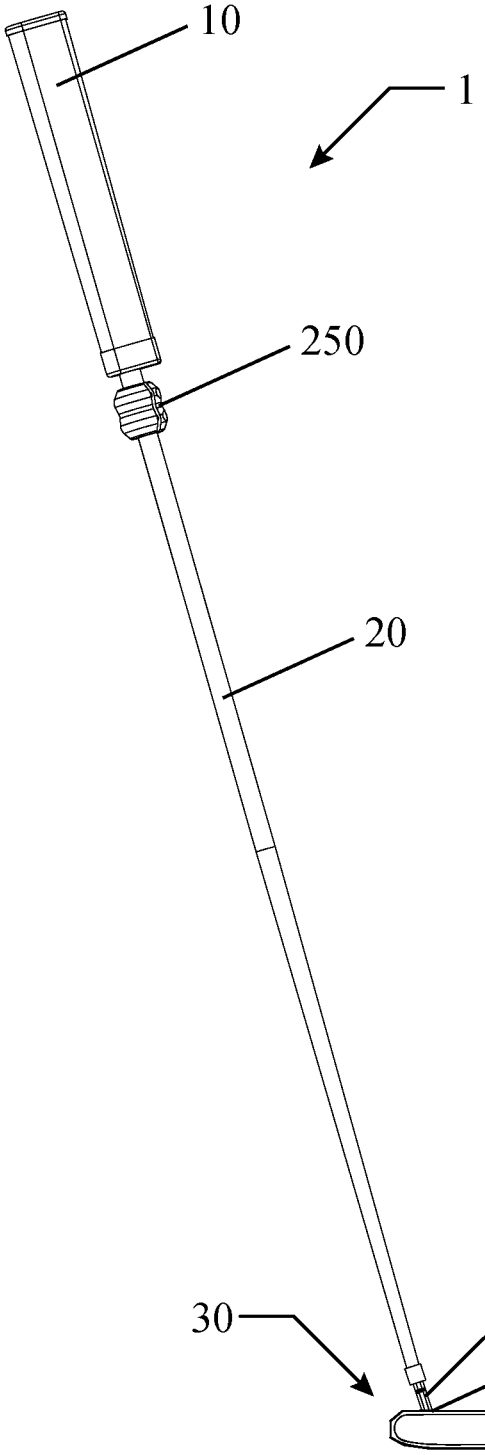

FIG. 16 shows a front view of the assembled multi-adjustable putter of FIGS. 1A-15 used as a left hand putter.

Figure 17:
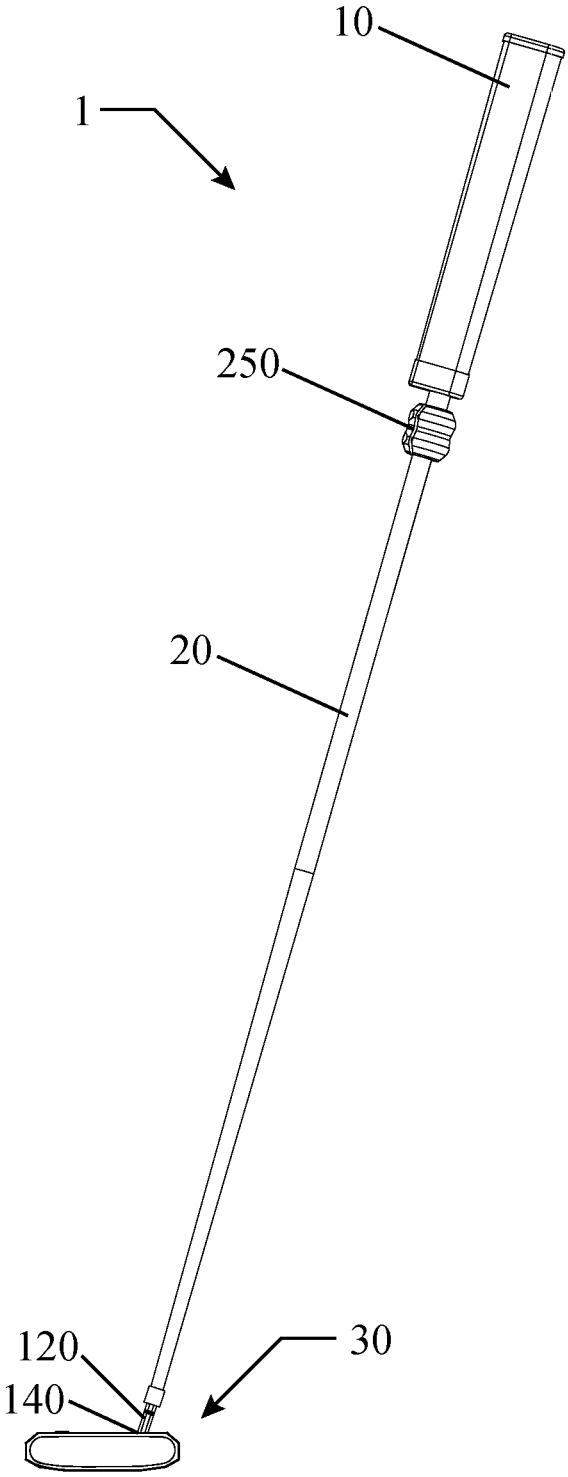

FIG. 17 shows a front view of the assembled multi-adjustable putter of FIGS. 1A-15 used as a right hand putter.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

A list of the components will now be described.

1 Assembled Multi-Adjustable Putter
10 handle (upper golf shaft with grip attached either circular or non-circular in shape)
20 lower golf shaft
30 putter head
32 front base for face plate
34 face plate
35 threaded socket on face plate
36 rear base for weights
39 screw fasteners
100 Adjustable Multi-Position Loft/Lie Angle Feature
110 fixed top attached shaft sleeve to shaft (3 degree angled hole that fits into lower golf shaft 20)
120 adjustment shaft sleeve with flat face edges
122 lower teeth end
125 threaded internal cavity
129 sleeve screw/bolt
130 right hand orientation receptacle for adjustment shaft sleeve
132 internal notches/slots 132 inside receptacle 130
140 left hand orientation receptacle for 140 left adjustment sleeve
142 lower end teeth slots
150 plug for use in receptacles 130 and 140
155 threaded internal cavity
159 plug screw/bolt
200 Telescoping shaft with adjustable length
210 Upper golf shaft where grip is attached
220 Horizontal grooves cut into upper golf shaft 210
230 threaded rod
250 shaft clamp—C-shape
251 elongated cylindrical opening pass through shaft length adjustment member
252 upper raised ring portion
253 upper threaded slot on one end of upper raised ring portion
254 lower raised ring portion
255 lower threaded slot on one end of lower raised ring portion
263 upper screw fastener for upper threaded slot
265 lower screw fastener for lower threaded slot
270 upper O-ring washer
280 lower O-ring washer
300 Adjustable Left and Right Hand Orientation
400 Adjustable Putter Face Angle
500 Adjustable Heal/Toe Weight Adjustment
510 Toe Cylindrical Weight (Right Hand Configuration)
512 screw fastener
515 weight through-hole
517 threaded socket for middle portion of putter head 32
520 Heal Cylindrical Weight (Left Hand Configuration)
522 screw fastener
525 weight through-hole
527 threaded socket for middle portion of putter head 32

Figure 1A:
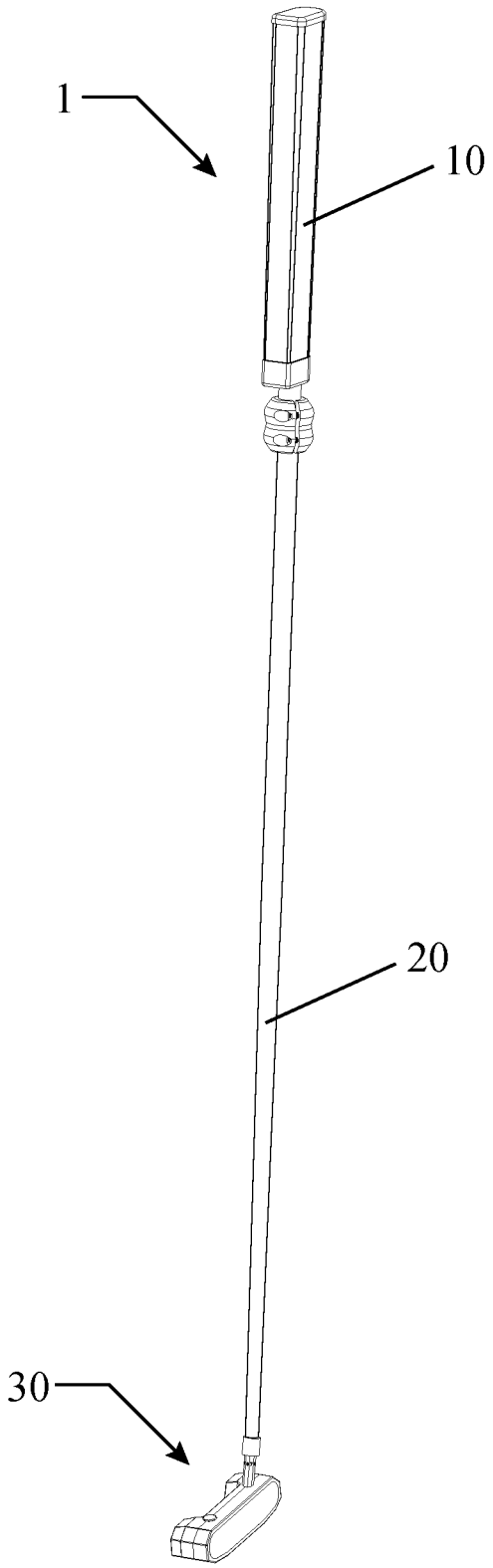
FIG. 1A is an upper left front perspective view of the multi-adjustable putter.

FIG. 1A is an upper left front perspective view of the multi-adjustable putter 1.

Figure 1B:
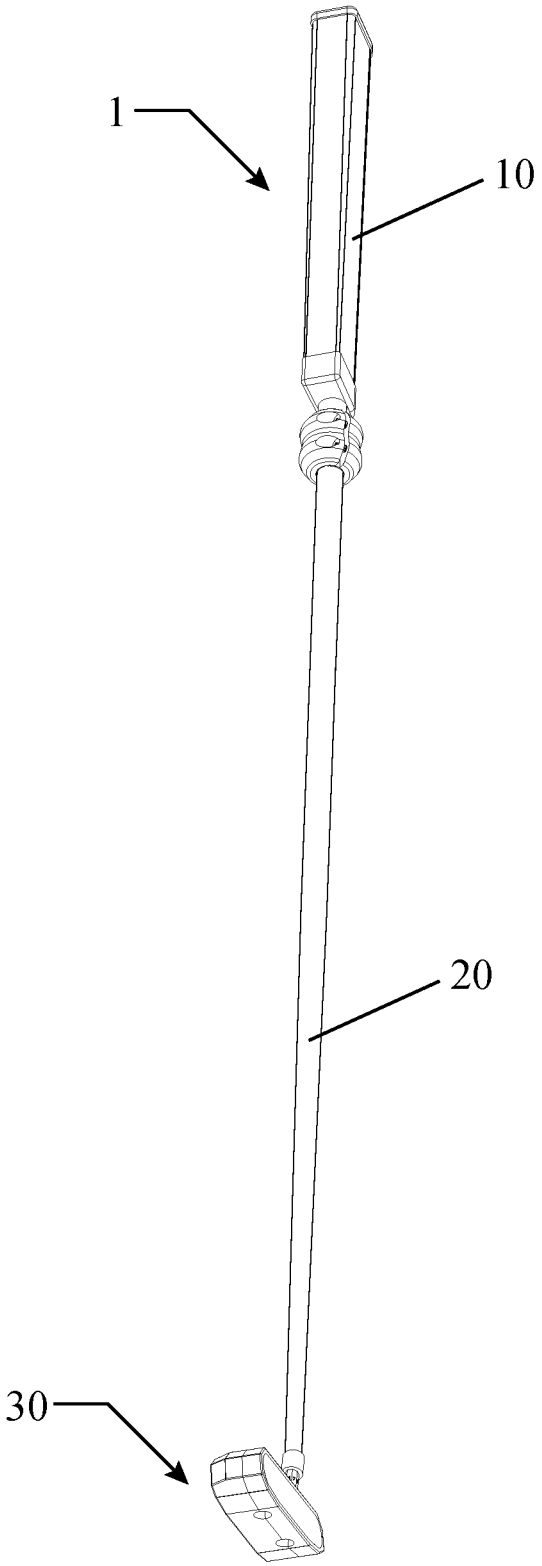
FIG. 1B is a lower left front perspective view of the multi-adjustable putter of FIG. 1A.

FIG. 1B is a lower left front perspective view of the multi-adjustable putter 1 of FIG. 1A.

Figure 2A:
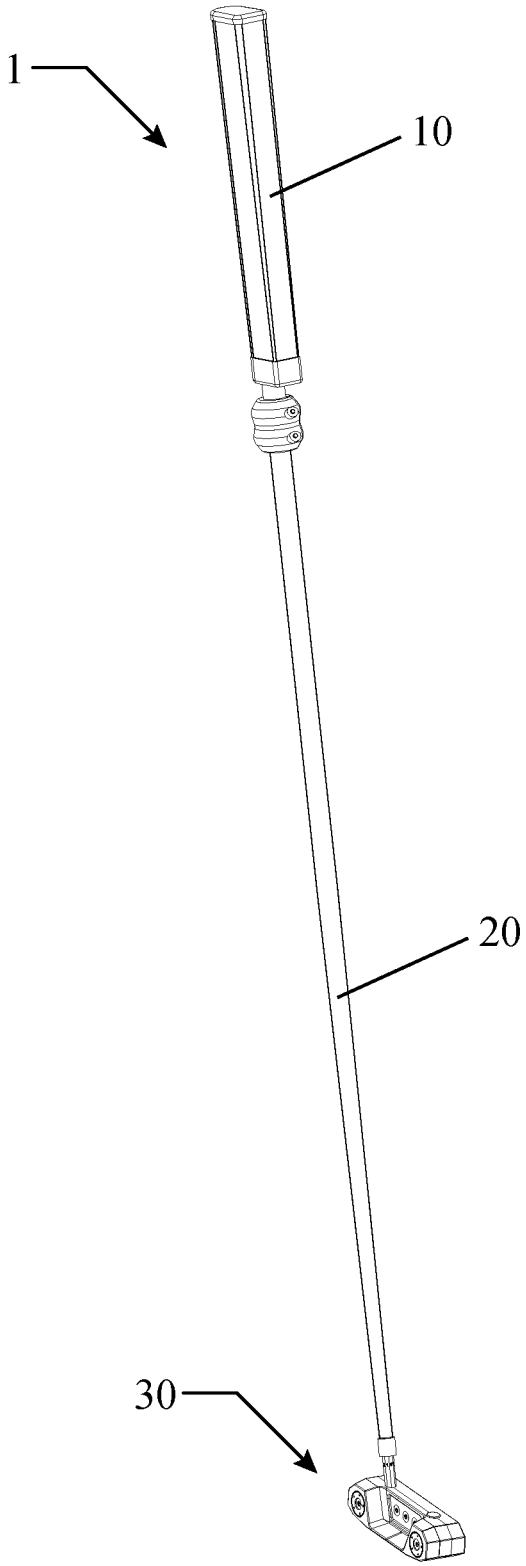
FIG. 2A is an upper right front perspective view of the multi-adjustable putter of FIG. 1A.
Figure 2B:
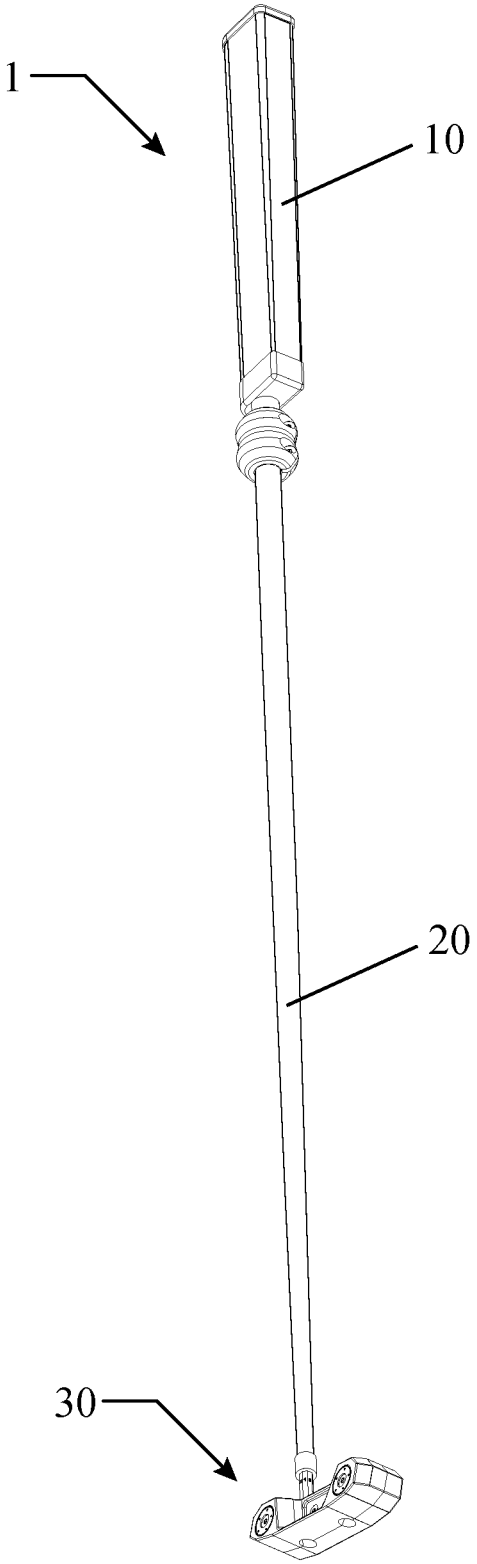
FIG. 2B is a lower left front perspective view of the multi-adjustable putter of FIG. 2A.

FIG. 2A is an upper right front perspective view of the multi-adjustable putter 1 of FIG. 1A. FIG. 2B is a lower left front perspective view of the multi-adjustable putter 1 of FIG. 2A.

Figure 3A:
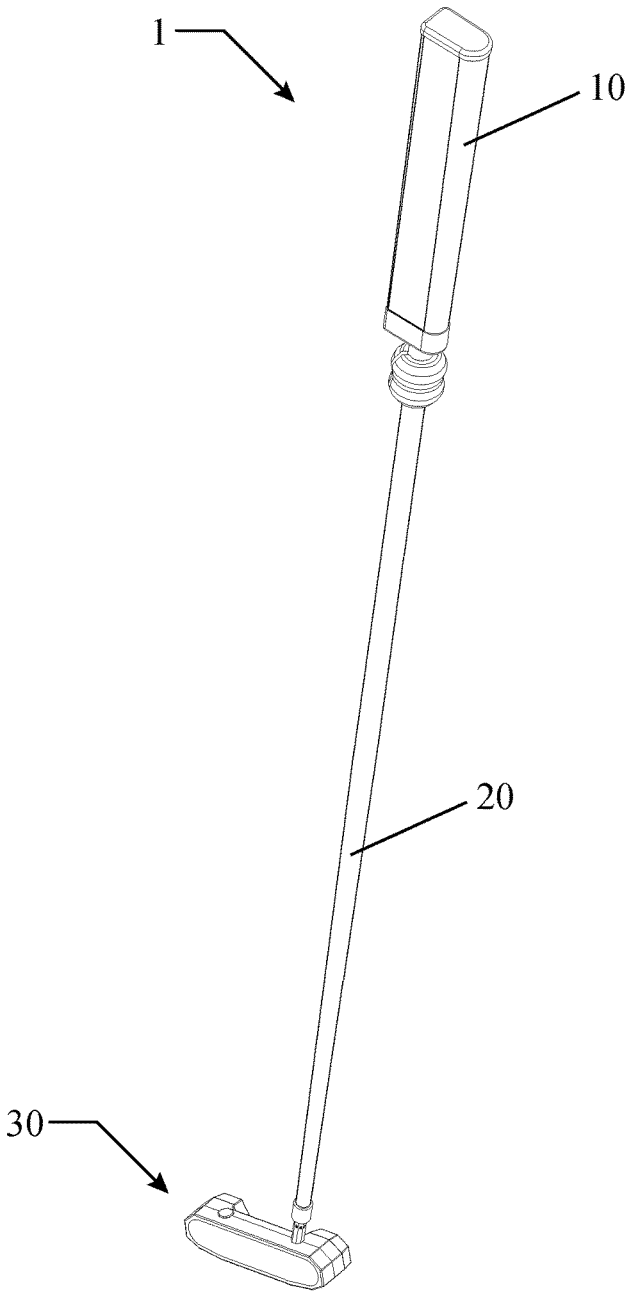
FIG. 3A is an upper left rear perspective view of the multi-adjustable putter of FIG. 1A.
Figure 3B:
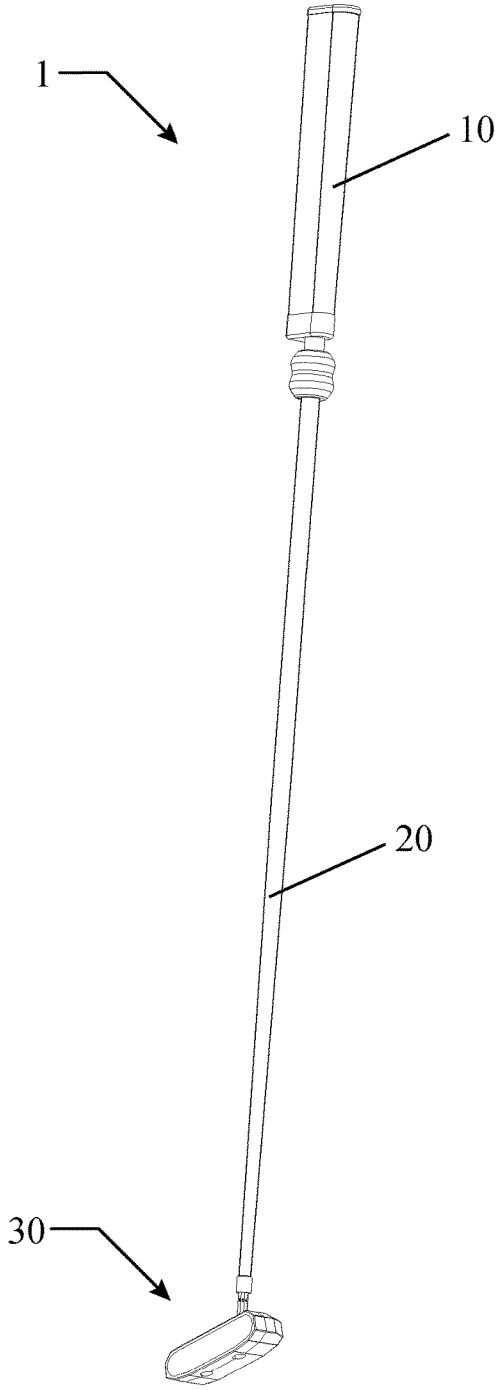
FIG. 3B is a lower left rear perspective view of the multi-adjustable putter of FIG. 3A.

FIG. 3A is an upper left rear perspective view of the multi-adjustable putter 1 of FIG. 1A. FIG. 3B is a lower left rear perspective view of the multi-adjustable putter 1 of FIG. 3A.

Figure 4A:
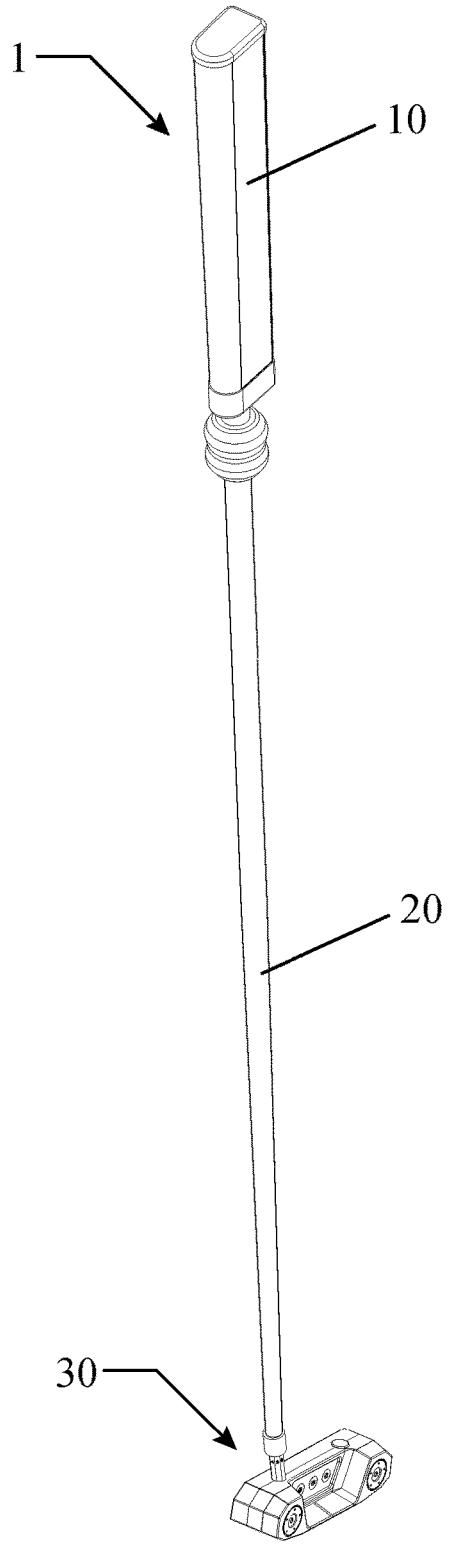
FIG. 4A is an upper right rear perspective view of the multi-adjustable putter of FIG. 1A.
Figure 4B:
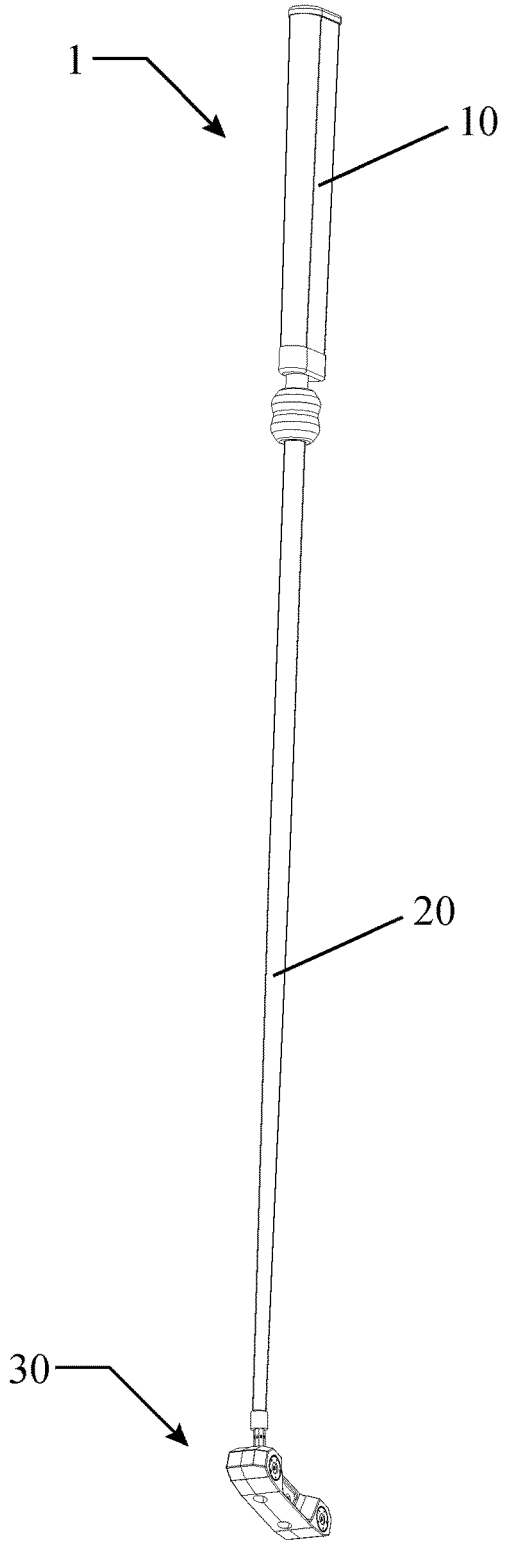
FIG. 4B is a lower right rear perspective view of the multi-adjustable putter of FIG. 1A.

FIG. 4A is an upper right rear perspective view of the multi-adjustable putter 1 of FIG. 1A. FIG. 4B is a lower right rear perspective view of the multi-adjustable putter 1 of FIG. 4B.

Figure 5A:
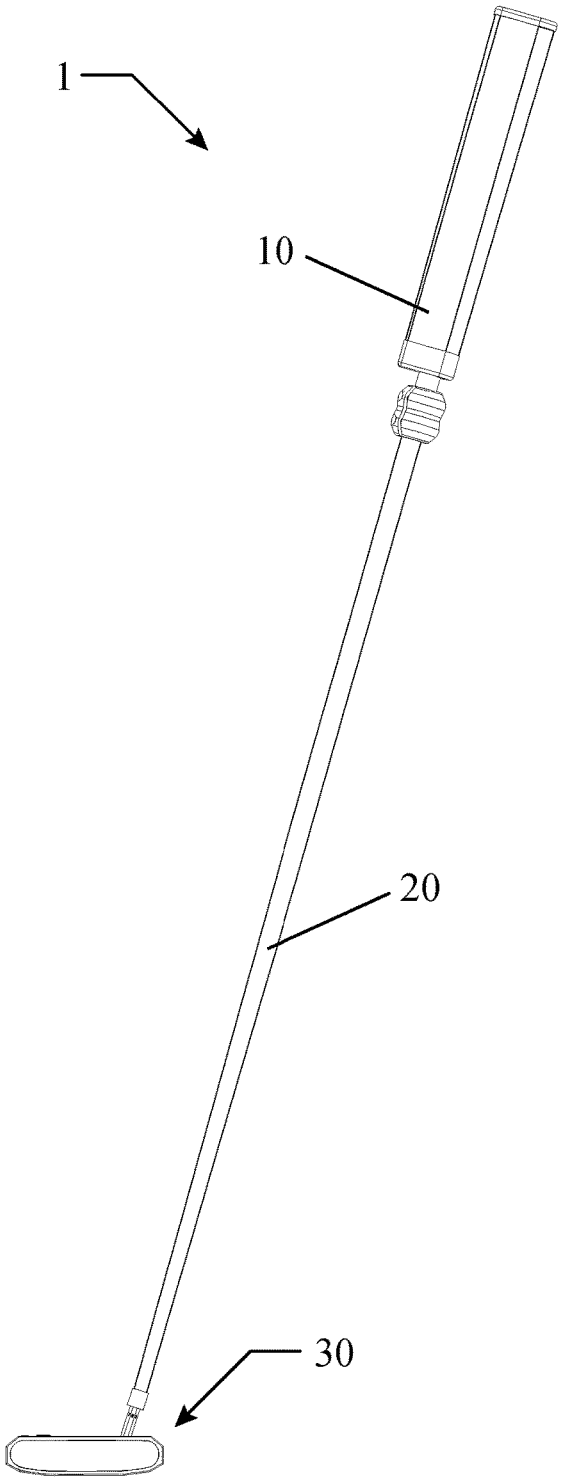
FIG. 5A is a left side view of the multi-adjustable putter of FIG. 1A in a right hand configuration.
Figure 5B:
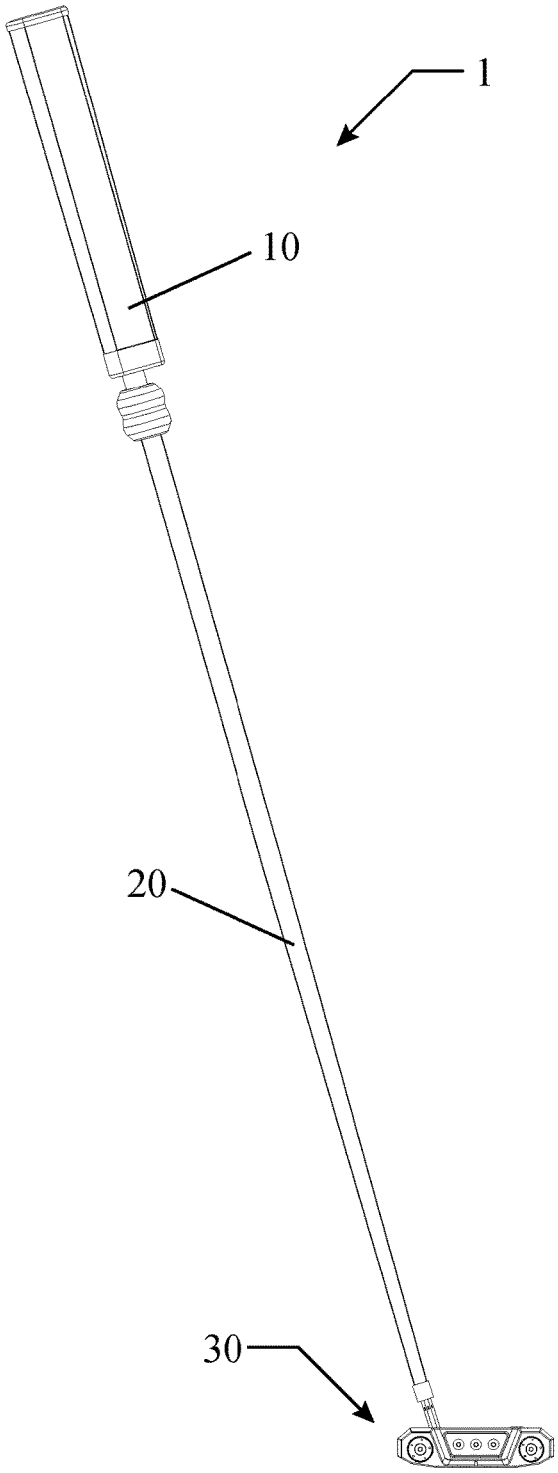
FIG. 5B is a right side view of the multi-adjustable putter of FIG. 1A in a right hand configuration.

FIG. 5A is a left side view of the multi-adjustable putter 1 of FIG. 1A. FIG. 5B is a right side view of the multi-adjustable putter 1 of FIG. 1A in right hand configuration.

Figure 6A:
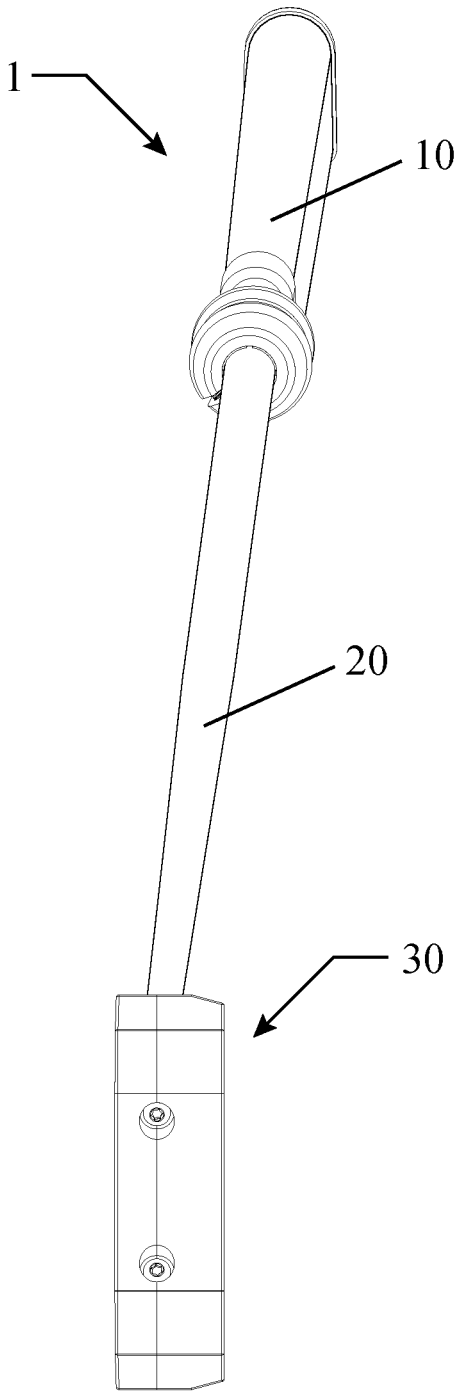
FIG. 6A is a bottom side view of the multi-adjustable putter of FIG. 1A.
Figure 6B:
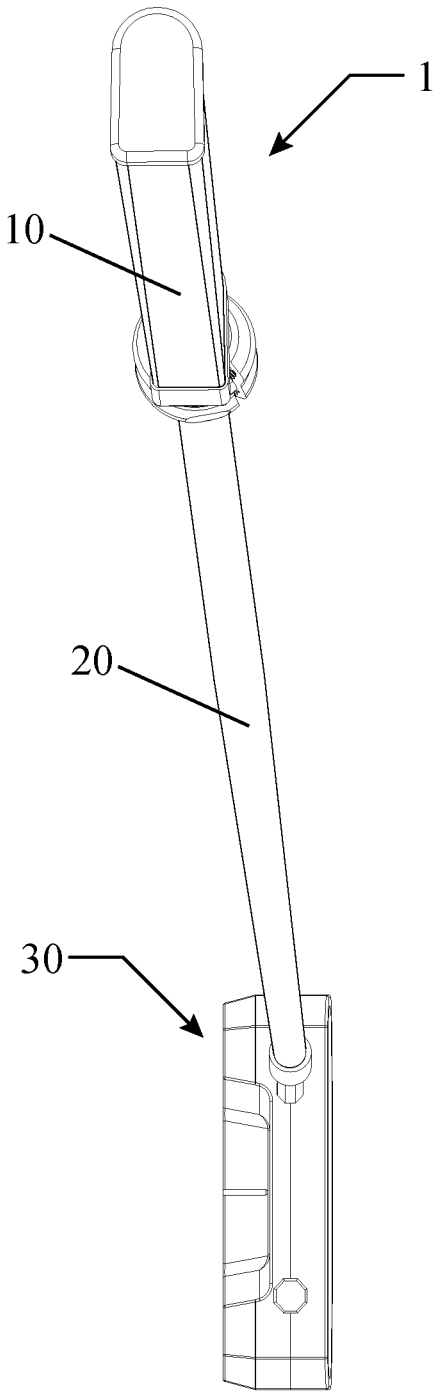
FIG. 6B is a top side view of the multi-adjustable putter of FIG. 1A.

FIG. 6A is a bottom side view of the multi-adjustable putter 1 of FIG. 1A. FIG. 6B is a top side view of the multi-adjustable putter 1 of FIG. 1A in right hand configuration.

Figure 7A:
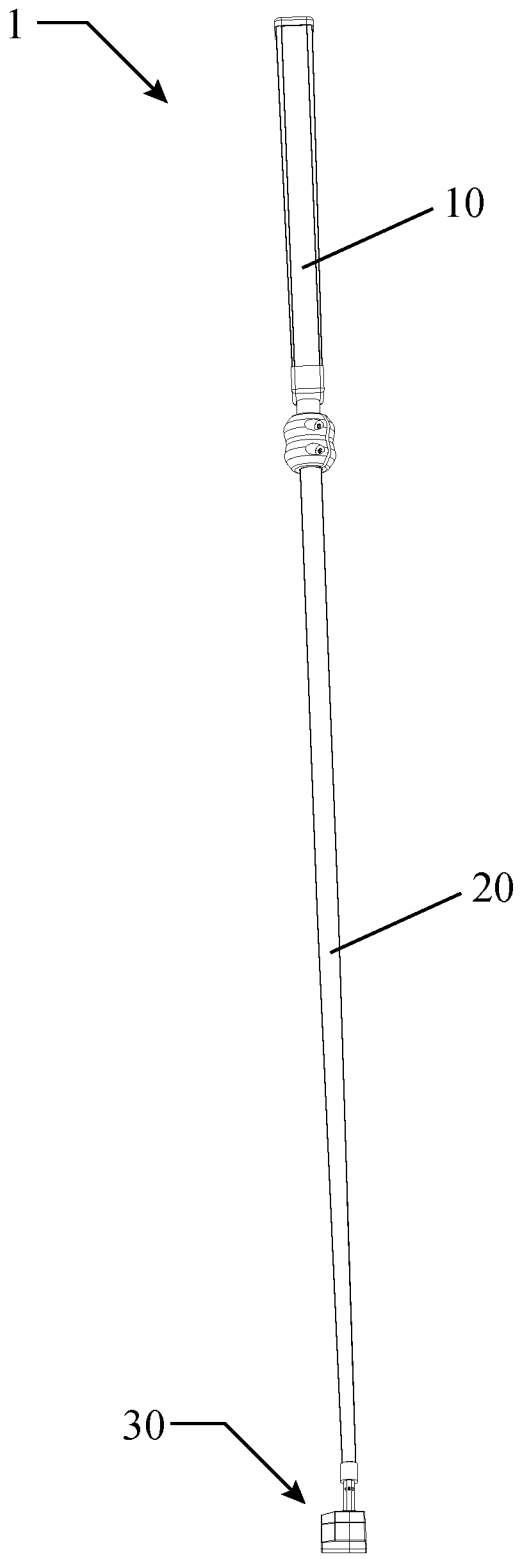
FIG. 7A is a front side view of the multi-adjustable putter of FIG. 1A.
Figure 7B:
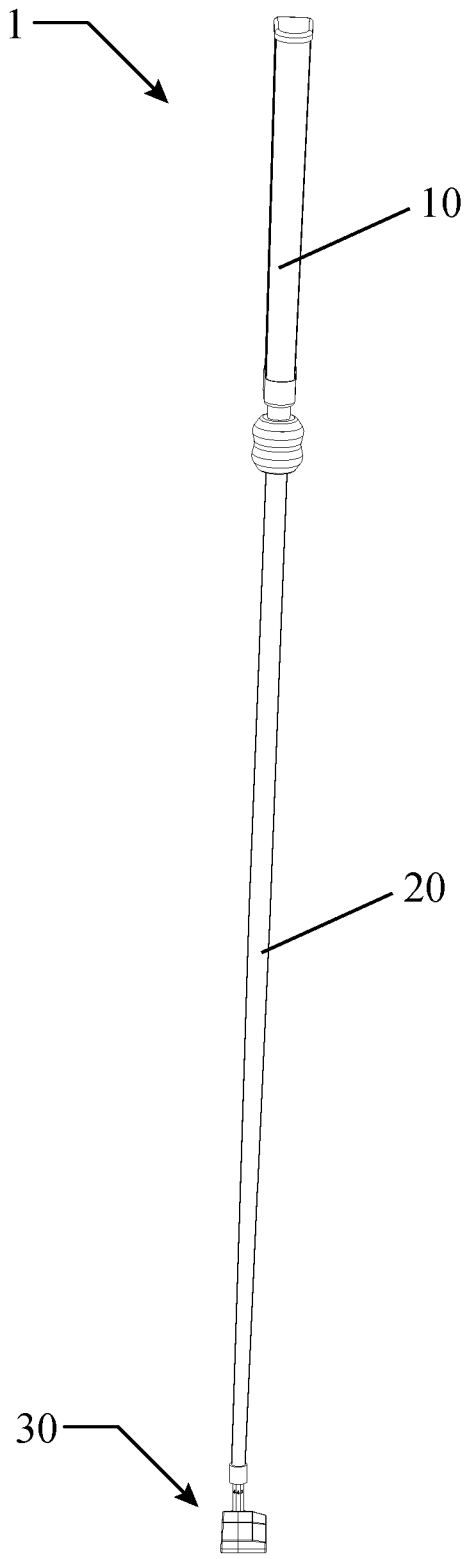
FIG. 7B is a rear side view of the multi-adjustable putter of FIG. 1A.

FIG. 7A is a front side view of the multi-adjustable putter 1 of FIG. 1A. FIG. 7B is a rear side view of the multi-adjustable putter 1 of FIG. 1A.

Figure 8A:
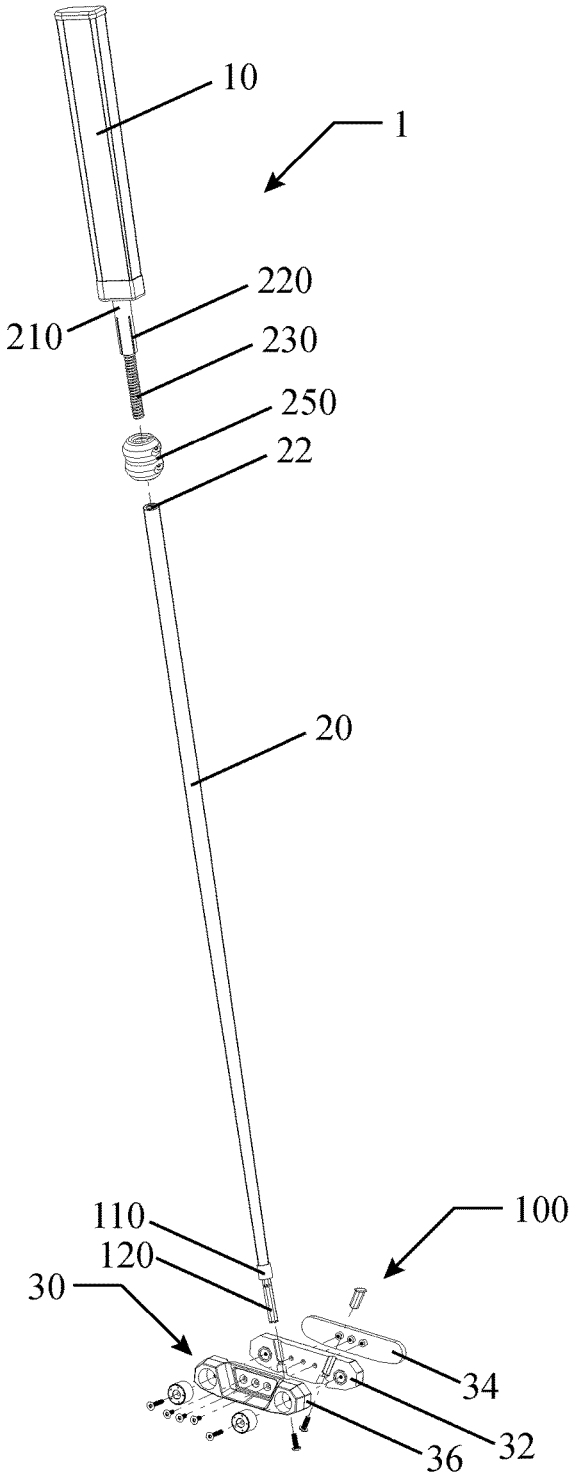
FIG. 8A is an upper rear exploded right view of the multi-adjustable putter of FIG. 2A.
Figure 8B:
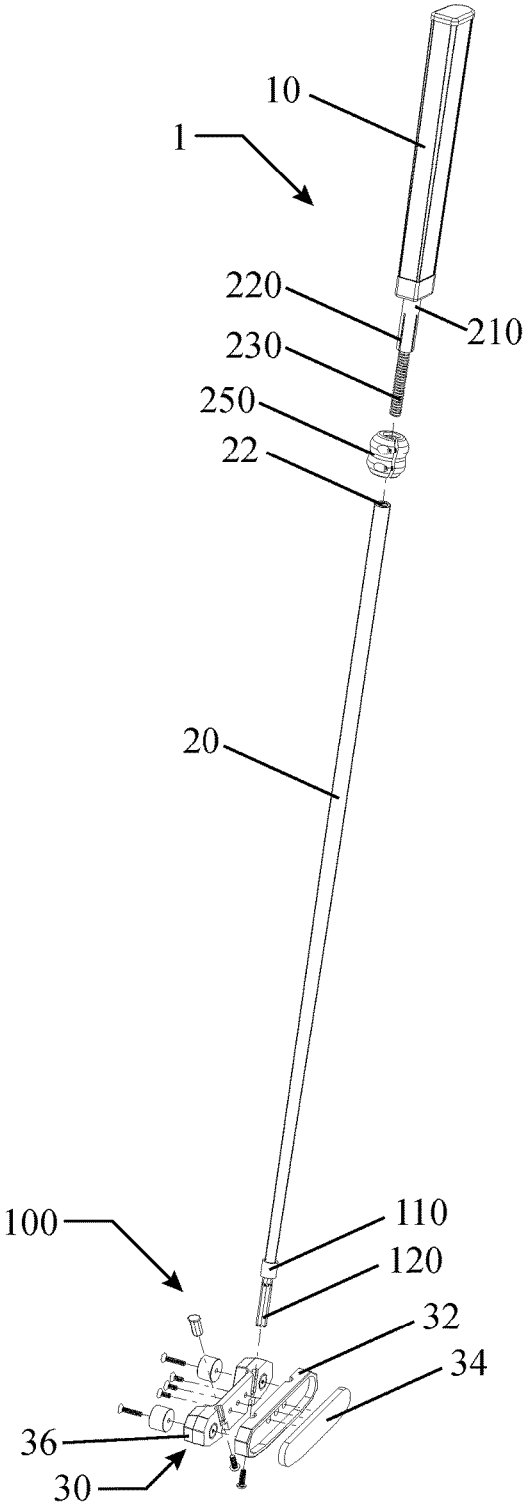
FIG. 8B is an upper front exploded view of the multi-adjustable putter of FIG. 8A.

FIG. 8A is an upper front exploded right view of the multi-adjustable putter 1 of FIG. 2A. FIG. 8B is an upper rear exploded view of the multi-adjustable putter 1 of FIG. 8A.

Referring to FIGS. 1A-8B, the putter 1 can include a handle 10, shaft 20 and putter head 30.

Adjustable Mult-Position Loft/Lie Angle 100

FIG. 9A is a front view of the putter head 30 face side with multi-position adjustable loft/lie angle shaft sleeve 120 in a right putter orientation slot 130 and plug 150 in left putter orientation slot. FIG. 9B is a rear view of FIG. 9A.

FIG. 10A is an enlarged toe view in right hand configuration of FIG. 9A. FIG. 10B is an enlarged heal view in right hand configuration FIG. 9A.

FIG. 11A is a cross-sectional view of the putter head 30 of FIG. 10A along arrow 11Y. FIG. 11B is an upper exploded rear perspective view of the putter head 30 of FIGS. 9A-11A showing the front face base 32.

FIG. 11C is another exploded perspective view of the putter head 30 of FIG. 11B with front base 32 with face plate 34 attached to rear base 36. Referring to FIGS. 11B-11D, interchangeable weights 510, 520 can be mounted sideways into openings/through-holes 515, 525 adjacent to toe end and heel end of the putter head 30.

FIG. 11D is another perspective view of the assembled putter head 30 with adjustment shaft sleeve 120 inserted in the right cavity 130, an installed plug 150 in left orientation cavity 140, and separate face plate.

FIG. 11E is a perspective view of the adjustment shaft sleeve 120 used in FIGS. 11A-11D, which shows the fixed top 110 which is attached to shaft 20, lower teeth end 122, and threaded internal cavity 125.

FIG. 11F is a perspective view of the inside surface of the front base 32 of the putter head 30 of FIG. 11D showing the adjustment shaft sleeve 120, without the plug 150.

FIG. 11G is a perspective view of the inside surface of the rear base 34 of the putter head 30 of FIG. 11D showing the adjustment shaft sleeve 120, without the plug 150. FIG. 11H is an enlarged perspective view of FIG. 11F.

Referring to FIGS. 9A-11H, the putter head 30 can include a front base 34 attached to a rear base 36 by screw type fasteners 39 that thread into rear facing threaded sockets 35 on the face plate 34. When fastened, the front base 32 will be sandwiched between the face plate 34 and the rear base 36.

When the putter is used for a right putter orientation, the adjustment shaft sleeve 120 with flat face edges is inserted into the right hand orientation receptacle 130 so that the lower teeth 122 mate with lower end teeth slots 132 in the bottom of the receptacle 130. The fixed top 110 is attached to the lower end of the putter shaft 20.

A sleeve screw/bolt 129 threads into an internal threaded cavity 125 inside the lower end of the adjustment shaft sleeve 120.

A plug 150 can be inserted into the none used left hand orientation receptacle 140. Another screw/bolt 159 threads into internal threaded cavity 155 of the plug 150.

Referring to FIGS. 11D-11H, the front base 32 is sandwiched together with the rear base 34 to form the putter head 30. As shown in FIG. 11E, the lower teeth end 122 can be shaped as a ring-shaped array of inwardly protruding triangular spaced apart teeth members 122 about a circular opening 125. As shown in FIG. 11E, each of the inwardly protruding triangular spaced apart teeth members 122 have a base along the outer perimeter of the adjustment shaft sleeve 120, and an apex opposite to the base, being adjacent the circular opening 125. When the adjustment shaft sleeve 120 is inserted into right hand orientation receptacle 130, the lower teeth end 122 the inwardly protruding triangular spaced apart teeth members 122 interlocks with the internal notches/slots 132, inside the receptacle 130. Lower end teeth slots 142 are within receptacle 140.

When the user wishes to use the putter 1 for a left handed orientation, the adjustment shaft sleeve 120 with inwardly protruding triangular spaced apart teeth members 122 about a circular opening 125 can be inserted into left hand orientation receptacle 140, which also has lower end teeth slots 142, and the plug 150 can be inserted into the right hand orientation receptacle 130, and be attached with respective sleeve screw/bolt 129 and plug screw/bolt 159. The lower teeth end 122 the inwardly protruding triangular spaced apart teeth members 122 interlocks with the internal notches/slots 142, inside the left hand receptacle 140

Table 1 shows the eight (8) different positions for using the adjustment shaft sleeve 120 with the right hand orientation receptacle 130.

TABLE 1

| 3 Degree Milled Putter Face | | | |
|---|---|---|---|
| Position | Loft in Degrees | Relative to Ground in Degrees | Lie in Degrees |
| A 1 | 3 | 93 | 69 |
| B 2 | 1.5 | 91.5 | 70.5 |
| C 3 | 0 | 90 | 72 |
| D 4 | 1.5 | 91.5 | 73.5 |
| E 5 | 3 | 93 | 75 |
| F 6 | 4.5 | 94.5 | 73.5 |
| G 7 | 6 | 96 | 72 |
| H 8 | 4.5 | 94.5 | 70.5 |

In Table 1, each of the Degree's component are "approximately" the listed value.

FIGS. 12A to 12F show the different orientations of the adjustment shaft sleeve 12 when inserted into the eight (8) different positions inside receptacle 130. The loft/lie adjustment can be made by drilling an approximately 3 degree angled drill hole on top of the shaft sleeve 110 to fit the lower portion of the second stepless golf shaft 20. Once the bottom portion of the shaft sleeve 120 is removed from the putter head 30 by either screws 129 or 159 depending on right or left handed configuration and rotated into any one of the eight different variations gives you the described loft/lie changes in table 1 above.

By changing more than an approximately 3 degree angled drill would result in more changes to loft/lie like for example having a 6 degree offset angled drill hole versus a 3 degree offset angled drill hole at the top of the shaft sleeve 110 or by also changing the putter head milled base 30 from approximately 3 degrees to being milled to approximately 4 degrees as the base model allows for even more variation of adjustable loft/lie features or any combination above.

For the references above and to be descriptive of the patent the offset angled drill hole at the top of the shaft sleeve 110 and the milled putter face will both be at approximately 3 degrees. The lower portion of the shaft sleeve 120 can be octagonal in shape which will fit into the top portion of the putter head 32 into either hole 130 or 140 of the putter head 30 which will be either broached or the putter head can be milled in two parts allowing for easier machining for the octagonal hole as described in 32 and 36.

The approximately 3 degrees of angled hole on the top of the shaft sleeve 110 allows for loft/lie to be adjusted from the original approximately 3 degree milled putter face by removing and turning then reinserting the shaft sleeve into one of the either eight different octagonal positions.

FIG. 12A is a front view of the putter head 30 with shaft 20 in a first loft/lie position representing a 69 degree lie angle relative to the ground. FIG. 12AR is a right end view of FIG. 12A representing an approximately 3 degrees of loft relative to the ground based upon an approximately 3 degree milled putter head.

FIG. 12B is a front view of the putter head 30 with shaft 20 in a second loft/lie position representing an approximately 70.5 degree lie angle relative to the ground. FIG. 12BR is a right end view of FIG. 12B representing approximately 1.5 degrees of loft relative to the ground based upon an approximately 3 degree milled putter head.

FIG. 12C is a front view of the putter head 30 with shaft in a third loft/lie position representing an approximately 72 degree lie angle relative to the ground. FIG. 12CR is a right end view of FIG. 12C representing approximately 0 degrees of loft relative to the ground based upon an approximately 3 degree milled putter.

FIG. 12D is a front view of the putter head 30 with shaft 20 in a fourth loft/lie position representing an approximately 73.5 degree lie angle relative to the ground. FIG. 12DR is a right end view of FIG. 12D representing approximately 1.5 degrees of loft relative to the ground based upon an approximately 3 degree milled putter head.

FIG. 12E is a front view of the putter head 30 with shaft 20 in a fifth loft/lie position representing an approximately 75 degree lie angle relative to the ground. FIG. 12ER is a right end view of FIG. 12E representing approximately 3 degrees of loft relative to the ground based upon an approximately 3 degree milled putter head.

FIG. 12F is a front view of the putter head 30 with shaft 20 in a sixth loft/lie position representing an approximately 73.5 degree lie angle relative to the ground. FIG. 12FR is a right end view of FIG. 12F representing approximately 4.5 degrees of loft relative to the ground based upon an approximately 3 degree milled putter head.

FIG. 12G is a front view of the putter head 30 with shaft 20 in a seventh loft/lie position representing a 72 degree lie angle relative to the ground. FIG. 12GR is a right end view of FIG. 12G representing approximately 6 degrees of loft relative to the ground based upon an approximately 3 degree milled putter head.

FIG. 12H is a front view of the putter head 30 with shaft 20 in an eighth loft/lie position representing an approximately 73.5 degree lie angle relative to the ground. FIG.

12HR is a right end view of FIG. 12H representing approximately 6 degrees of loft relative to the ground based upon an approximately 3 degree milled putter head.

Adjustable Putter Face Angle 400

FIG. 13A is a top perspective view of the assembled multi-adjustable putter 1 for a right handed golfer with face plate angle relative to the golfer rotated counter-clockwise at approximately 3 degrees. For a right handed golfer the closed position may be used for those golfers that want to counteract the effects of a pushed putter stroke. Referring to FIGS. 13A, 14 and 15, this is achieved by loosening both screws 263 and 265 of the shaft clamp 250 and rotating the upper golf shaft 10 clockwise while the lower golf shaft and putter head remains stationary for a right handed configuration.

In a left handed configuration, the upper golf shaft 10 is rotated counterclockwise while loosening screws 263 and 265 of the shaft clamp 250 while the lower putter shaft and head remains stationary for a closed left handed configuration. Variation of degrees opened or closed is dependent on how much to rotate the upper golf shaft 10 and tightening screws 263 and 265 of the shaft clamp 250 in a fixed face angle position.

FIG. 13B is a top perspective view of the assembled multi-adjustable putter for a right handed golfer with face plate angle perpendicular to ground. For a right handed golfer this position may be preferred for a straight 90 setup relative to the golfer.

FIG. 13C is a top perspective view of the assembled multi-adjustable putter for a right handed golfer with face plate angle relative to the golfer rotated clockwise at approximately 3 degrees. For a right handed golfer the open position may be used for those golfers want to counteract the effect of a pulled putter stroke. Referring to FIGS. 13C, 14 and 15, this is achieved by loosening both screws 263 and 265 of the shaft clamp 250 and rotating the upper golf shaft 10 counterclockwise while the lower golf shaft and putter head remains stationary for a right handed configuration.

In a left handed configuration, the upper golf shaft 10 is rotated clockwise while loosening screws 263 and 265 of the shaft clamp 250 while the lower putter shaft and head remains stationary for a closed left handed configuration. Variation of degrees opened or closed is dependent on how much to rotate the upper golf shaft 10 and tightening screws 263 and 265 of the shaft clamp 250 in a fixed position face angle position.

Telescoping Shaft with Adjustable Length 200

FIG. 14 shows an exploded perspective view of the handle 10, shaft 20 and shaft length adjustable member 200.

FIG. 15 shows an exploded perspective view of the length adjustable member 250 of FIG. 14.

Referring to FIGS. 1A-8B, and 14-15, the handle 10 can have a lower extending hollow stem 210 with separate finger members 220, with internal threaded walls inside. A top of a threaded rod 230 can be threaded into the separate finger members 220 and lower extending hollow stem 210.

An upper end of the shaft 20 can have a threaded opening 22. A shaft length adjustment member 250 having a general C-shape configuration can be formed from a pliable and bendable material. The material can be either stainless steel, brass, or aluminum that would allow the shaft clamp 250 to tighten down on the upper shaft horizontal grooves of the upper golf shaft handle 10.

The length of the putter can be adjusted by loosening screws 263 and 265 of the shaft clamp 250 and rotating the upper golf shaft handle 10 clockwise to shorten putter length or rotate the golf shaft handle 10 counterclockwise to lengthen the overall putter shaft. The shaft length is adjustable by utilizing two stepless putter shafts, one cut to length just enough to fit the putter grip and shaft clamp with approximately 4 horizontal cuts approximately 2 inches in length 220 in which the shaft clamp 250 is fixed and the second golf shaft 20 is fitted through the first golf shaft 10. The golf grip can be installed after the second shaft is fitted into the first stepless golf shaft and the golf grip will be non-circular shaped.

The outside of the shaft length adjustment member 250 can have an upper raised ring portion 252 having a generally C-shape with an upper threaded slot 253 on one end. The outside of the shaft length adjustment member 250 can have a lower raised ring portion 254 having a generally C-shape with a lower threaded slot 255 on one end. An elongated cylindrical opening 251 can pass through a main vertical axis of the shaft length adjustment member 250.

For assembly the lower end of the threaded rod 230 can pass through the upper O-ring washer and into the top of the shaft length adjustment member 250 and pass out of the bottom of the shaft length adjustment member 250 through the lower O-ring washer 280 and into the upper threaded end 22 of the shaft 20.

The lower end of the rod 230 can be moved downward so that the separate fingers 220 from the stem 210 are inside the shaft length adjustment member 250. The handle 10 can be rotated until a desired length is achieved for the putter to be used.

When a desired shaft length is achieved, the user can tighten upper screw fastener 263 into upper threaded slot 253, and tighten lower screw fastener 265 into lower threaded slot 255, until the shaft length adjustment member 250 locks the position of the handle t0 relative to the shaft 20. To adjust the shaft length, the user can reverse the above process.

Adjustable Left and Right Hand Orientation 300

Referring to FIGS. 8A-11E, the adjustment shaft sleeve 120 can be inserted into right hand orientation receptacle 130 in putter head 20 and attached by sleeve screw/bolt 129, and plug 150 inserted into left hand orientation receptacle 140, and held by plug screw/bolt 159 which will allow the assembled putter to be used as a right hand putter.

Both octagonal holes 130 and 140 on the putter head will be machined at 72 degrees relative to the ground but can be milled between 62 to 82 degrees perpendicular to the golfer or slightly offset allowing for further adjustments in loft/lie angle.

Referring to FIGS. 8A-11E, the adjustment shaft sleeve 120 can be inserted into left hand orientation receptacle 140 in putter head 20 and attached by sleeve screw/bolt 129, and plug 150 inserted into right hand orientation receptacle 130, and held by plug screw/bolt 159 which will allow the assembled putter to be used as a right hand putter.

FIG. 16 shows a front view of the assembled multi-adjustable putter 1 of FIGS. 1A-15 used as a right hand putter with the adjustment shaft sleeve 120 inserted into left hand orientation receptacle 130.

FIG. 17 shows a front view of the assembled multi-adjustable putter 1 of FIGS. 1A-15 used as a left hand putter with the adjustment shaft sleeve 120 inserted into the right hand orientation receptacle 140.

Adjustable Heal/Toe Weight Adjustment 500

Removable weights of different metal or material densities can be used to allow for more or less weight in the heal or toe of the putter or a combination of both.

Approximately two recessed holes at the back heal and toe of the putter can allow for changing out the weights which will be attached by Torx screws.

On the bottom of the putter, approximately two slightly recess holes can be used for the Torx shaft screw(s) to fit to the bottom portion of the octagonal shaft sleeve which can be tapped to allow for fastening of a bottom shaft Torx screw.

Referring to FIGS. 9B, and 11B-11D, the cylindrical weights for heal and toe in the putter head 30 will now be described. A cylindrical weight 510 can be inserted into a cylindrical receptacle in the rear base 36, and a fastener, such as a screw 512 can pass through the weight 510 though a through-hole 515 and into a threaded socket 517 in the middle putter head 32 of the putter, to form a heal weight for the putter head 30 in a right hand configuration.

Another cylindrical weight 520 can be inserted into a cylindrical receptacle in the rear base 36, and a fastener, such as a screw 522 can pass through the weight 520 though a through-hole 525 and into a threaded socket 527 in the middle putter head 32 of the putter, to form a toe weight for the putter head 30.

The cylindrical weights 510, 520 can alternate to be a toe weight and heal weight when the adjustment shaft sleeve 120 is moved to the left hand orientation receiver. Varying heal and toe weights can provide for face angle balancing through the putter stoke or push more weight to the heal or toe to counteract those tendencies of pushed and pulled putter strokes.

Table 2 shows the different weight amounts when using different materials for the different cylindrical weights, such as the toe weight 510 and heal weight 520

TABLE 2

| Heal/Toe Adjustable Wts | Material | Weight in Grams (Each Weight) |
|---|---|---|
| Heal Weight | Stainless Steel | Approx. 26 g |
| Toe Weight | Stainless Steel | Approx. 26 g |
| Heal Weight | Brass | Approx. 28 g |
| Toe Weight | Brass | Approx. 28 g |
| Heal Weight | Tungsten | Approx. 64 g |
| Toe Weight | Tungsten | Approx. 64 g |
| Heal Weight | Aluminum | Approx. 9 g |
| Toe Weight | Aluminum | Approx. 9 g |
| Heal Weight | Carbon Fiber | Approx. 6.6 g |
| Toe Weight | Carbon Fiber | Approx. 6.6 g |
| Heal Weight | Plastic | Approx. 5 g |
| Toe Weight | Plastic | Approx. 5 g |

Using the same type of metal/material in the heal or toe weights can achieve a specific putter swing weight to the head of the putter. Heavier denser metals/materials would increase the swing weight of the putter while a lighter less dense metal/materials would lower the overall putter swing weight and achieve a certain desired feel or affect by using the same type of metal/material or any variation of the above.

In a right handed configuration a heavier denser metal/material in the toe of the putter and a lighter metal/material in the heal may be beneficial for those who tend to pull their puts or reverse the arrangement of weights for those who have a tendency to push their putts.

Tungsten weights could be used for providing an overall higher swing weight to the putter head or to provide a heavier denser metal where more weight in the heal or toe is needed whereas Aluminum weights could be used for providing an overall lower swing weight to the putter head or to provide a lighter metal for less weight in the heal or toe if needed Interchangeable Face Plate and Weights 600

The front of the putter head 30 can be recessed to allow for different types of face plates 34, such as but not limited to, metal, wood, plastics, foam, carbon fiber, and the like, to achieve the desired feel and sound of the putter.

The face plate can be attached by approximately three set Torx screws 39 from the back of the putter 36.

Referring to FIGS. 9A and 11B-11D, the face plate 34 can be attached to the putter by screw fasteners, such as Torx screws 39 that pass through three corresponding through-holes in rear base 34 and through three corresponding through-holes in front base 32 and into mateable threaded sockets 35 on the back of the face plate 34.

Table 3 shows the face plate adjustable insert materials and their respective weights.

TABLE 3

| Heat/Toe Adjustable Weights | Weight in Grams |
|---|---|
| Stainless Steel | Approx. 100 g |
| Brass | Approx. 106 g |
| Tungsten | Approx. 249 g |
| Aluminum | Approx. 35 g |
| Carbon Fiber | Approx. 25 g |
| Plastic | Approx. 20 g |
| Foam Rubber | Approx. 45 gm |

Using different face plate materials in effect changes the overall feel, sound and length of a putt utilizing the same putter stroke. As an example, utilizing a tungsten face plate versus a carbon fiber face plate allows for a higher putter weight and in turn a longer putt versus a carbon fiber face plate utilizing the same speed of a putter stroke.

The shaft length is adjustable by utilizing two stepless putter shafts, one cut to length just enough to fit the putter grip and shaft clamp with approximately 4 horizontal cuts approximately 2 inches in length in which the clamp is fixed and the second shaft is fitted through the first shaft.

The golf grip can be installed after the second shaft is fitted into the first stepless golf shaft.

The golf grip utilized will not be circular shaped.

The loft/lie adjustment can be made by drilling an approximately 3 degree angled drill hole on the shaft sleeve to fit the lower portion of the second stepless golf shaft.

By turning the second golf shaft different combinations of loft/lie can be achieved. More than an approximately 3 degree angled drill would result in more changes to loft and lie.

The lower portion of the shaft sleeve can be octagonal in shape which will fit into the top portion of the putter head which will be either broached or the putter head can be milled in two parts allowing for easier machining for the octagonal hole.

The octagonal hole in the putter head can be drilled at roughly an approximately 72 degree angle.

The front of the putter can be recessed to allow for different types of face plates, metal, wood, plastics, foam, carbon fiber, and the like, to achieve the desired feel and sound of the putter.

The face plate can be attached by approximately three set Torx screws from the back of the putter.

Referring to FIGS. 11B-11D, the face plate 34 can be attached by approximately three set Torx screws 39 from the back 36 of the putter 30.

The symbol "/" referenced in this application includes both terms before and after the "/" symbol, are in combination together.

The symbol of "/" can be interpreted as the term "and."

The term "approximately"/"approximate"/"Approx." can be +/−15% of the amount referenced. Additionally, preferred amounts and ranges can include the amounts and ranges referenced without the prefix of being approximately.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

The invention claimed is:

1. A multi-adjustable golf putter, consisting of:

an upper handle 10 attached to an upper shaft 210 in a straight configuration;

a telescoping shaft 230, 22, 20 having an adjustable length;

a multi-position adjustable loft and lie angle that includes a lower shaft 20 insertable into a three degree angled drill hole in a top of a shaft sleeve 110 having an octagonal shape with flat side edges, the shaft sleeve 110 has lower teeth end 122 which mates and aligns with internal notches and openings 132 in a bottom of an octagonal shape receptacle 130 on top of a putter head 30, wherein removing and inserting the shaft sleeve 110 into the receptacle 130 in a plurality of positions adjusts the loft and lie angle, wherein each of the plurality of positions includes loft angle in degrees, relative to ground in degrees and lie in degrees, and plurality of positions includes up to eight positions, wherein the lower teeth end 122 includes:

a ring shaped array of inwardly protruding triangular spaced apart teeth members 122 about a circular opening 125 which mates and interlocks with the internal notches and openings 132 in a bottom of the octagonal shape receptacle 130, each of the inwardly protruding triangular spaced apart teeth members 122 having a base along an outer perimeter of the shaft sleeve 120, and an apex portion opposite to the base being adjacent to the circular opening 125;

an adjustable putter face angle that includes: a clamp member for the telescoping shaft, which allows an upper golf shaft to retract and expand relative to a lower golf shaft, wherein rotating the upper golf shaft clockwise to a stationary lower golf shaft adjusts the face angle for a right handed configuration golf putter, and rotating the upper golf shaft counter-clockwise to a stationary lower golf shaft adjusts the face angle for a left handed configuration golf putter;

an adjustable heel/toe weight adjustment, wherein the adjustable heel/toe weight adjustment, includes interchangeable weights in heel and toe portions of a rear base of the putter; and an adjustable left- and right-hand orientation consisting of:

the octagonal shape receptacle 130 forming a right hand orientation receptacle 130 in a top portion of the putter head for allowing the putter to be used as a right hand putter; and a first screw/bolt threads into an internal threaded cavity inside the lower teeth end of the shaft sleeve, wherein the first screw/bolt being countersunk beneath a bottom of the putter;

another octagonal shape receptacle similar to the octagonal shape receptacle 130 forming a left hand orientation receptacle 140 in another top portion of the putter head for allowing the putter to be used as a left hand putter; and a second screw/bolt threads into the internal threaded cavity inside the lower teeth end of the shaft sleeve, wherein the second screw/bolt being countersunk beneath the bottom of the putter.

2. A multi-adjustable golf putter, comprising:

an upper handle 10 attached to an upper shaft in a straight configuration;

a telescoping shaft with an adjustable length includes:

a lower extending hollow stem below the upper shaft with separate finger members 220 having internal threaded walls inside;

a threaded rod rotatably supported within the separate finger members;

a C-shaped shaft clamp having an elongated cylindrical opening from a top to a bottom to receive the threaded rod, and two side screw fasteners which mate into two side slots to tighten or loosen the C-shaped clamp about the threaded rod, and having a loosen and tighten position;

the lower shaft having an upper end with a threaded opening for receiving a bottom of the threaded rod, wherein the adjustable length of the telescoping shaft is shortened by rotating the two side screws to the loosen position, rotating the handle clockwise until a selected length is achieved and rotating the two side screws to the tighten position, wherein the adjustable length of the telescoping shaft is lengthened by rotating the two side screws to the loosen position, rotating the handle counter-clockwise until another selected length is achieved and rotating the two side screws to the tighten position;

a multi-position adjustable loft and lie angle that includes a lower shaft 20 insertable into a three degree angled drill hole in a top of a shaft sleeve 110 having an octagonal shape with flat side edges, the shaft sleeve 110 has lower teeth end 122 which mates and aligns with internal notches and openings 132 in a bottom of an octagonal shape receptacle 130 on top of a putter head 30, wherein removing and inserting the shaft sleeve 110 into the receptacle 130 in a plurality of positions adjusts the loft and lie angle;

wherein the lower teeth end 122 includes:

a ring shaped array of inwardly protruding triangular spaced apart teeth members 122 about a circular opening 125 which mates and interlocks with the internal notches and openings 132 in a bottom of the octagonal shape receptacle 130, each of the inwardly protruding triangular spaced apart teeth members 122 having a base along an outer perimeter of the shaft sleeve 120, and an apex portion opposite to the base being adjacent to the circular opening 125;

an adjustable heel/toe weight adjustment, wherein the adjustable heel/toe weight adjustment includes interchangeable weights in heel and toe portions of a rear base of the putter;

an adjustable putter face angle and;

an adjustable left and right hand orientation consisting of:

the octagonal shape receptacle 130 forming a right hand orientation receptacle 130 in a top portion of the putter head for allowing the putter to be used as a right hand putter; and a first screw/bolt threads into an internal threaded cavity inside the lower teeth end of the shaft sleeve, wherein the first screw/bolt being countersunk beneath a bottom of the putter;

another octagonal shape receptacle similar to the octagonal shape receptacle 130 forming a left hand orientation receptacle 140 in another top portion of the putter head for allowing the putter to be used as a left hand putter; and a second screw/bolt threads into the internal threaded cavity inside the lower teeth end of the shaft sleeve, wherein the second screw/bolt being countersunk beneath the bottom of the putter.

3. The multi-adjustable golf putter of claim 2, wherein each of the plurality of positions includes:

loft angle in degrees, relative to ground in degrees and lie in degrees.

4. The multi-adjustable golf putter of claim 2, wherein the plurality of positions includes up to eight positions.

5. A multi-adjustable golf putter, comprising:

an upper handle attached to an upper shaft in a straight configuration;

a telescoping shaft with an adjustable length includes:

a lower extending hollow stem below the upper shaft with separate finger members 220 having internal threaded walls inside;

a threaded rod rotatably supported within the separate finger members;

a C-shaped shaft clamp having an elongated cylindrical opening from a top to a bottom to receive the threaded rod, and two side screw fasteners which mate into two side slots to tighten or loosen the C-shaped clamp about the threaded rod, and having a loosen and tighten position;

the lower shaft having an upper end with a threaded opening for receiving a bottom of the threaded rod, wherein the adjustable length of the telescoping shaft is shortened by rotating the two side screws to the loosen position, rotating the handle clockwise until a selected length is achieved and rotating the two side screws to the tighten position, wherein the adjustable length of the telescoping shaft is lengthened by rotating the two side screws to the loosen position, rotating the handle counter-clockwise until another selected length is achieved and rotating the two side screws to the tighten position;

a multi-position adjustable loft and lie angle that includes a lower shaft insertable into a three degree angled drill hole in a top of a shaft sleeve having an octagonal shape with flat side edges, the shaft sleeve has lower teeth end which mates and aligns with internal notches and openings in a bottom of an octagonal shape receptacle on top of a putter head, wherein removing and inserting the shaft sleeve into the receptacle in a plurality of positions adjusts the loft and lie angle;

an adjustable heel/toe weight adjustment, wherein the adjustable heel/toe weight adjustment includes interchangeable weights in side heel and side toe portions of a rear side base of the putter;

an adjustable putter face angle; and wherein the lower teeth end of the shaft sleeve includes:

a ring shaped array of inwardly protruding triangular spaced apart teeth members about a circular opening which mates and interlocks with the internal notches and openings in a bottom of the octagonal shape receptacle, each of the inwardly protruding triangular spaced apart teeth members having a base along an outer perimeter of the shaft sleeve, and an apex portion opposite to the base being adjacent to the circular opening;

an adjustable left and right hand orientation consisting of:

the octagonal shape receptacle forming a right hand orientation receptacle in a top portion of the putter head for allowing the putter to be used as a right hand putter; and a first screw/bolt threads into an internal threaded cavity inside the lower teeth end of the shaft sleeve, wherein the first screw/bolt being countersunk beneath a bottom of the putter;

another octagonal shape receptacle similar to the octagonal shape receptacle forming a left hand orientation receptacle in another top portion of the putter head for allowing the putter to be used as a left hand putter; and a second screw/bolt threads into the internal threaded cavity inside the lower teeth end of the shaft sleeve, wherein the second screw/bolt being countersunk beneath the bottom of the putter.

6. The multi-adjustable golf putter of claim 5, wherein each of the plurality of positions includes:

loft angle in degrees, relative to ground in degrees and lie in degrees.

7. The multi-adjustable golf putter of claim 5, wherein the plurality of positions includes up to eight positions.

* * * * *